US011629470B2

(12) United States Patent
Fisher et al.

(10) Patent No.: US 11,629,470 B2
(45) **Date of Patent: *Apr. 18, 2023**

(54) BOLLARD WALL GATE SYSTEM

(71) Applicant: TGR Construction, Inc., Tempe, AZ (US)

(72) Inventors: Thomas G. Fisher, Dickinson, ND (US); Gregory L. Schafer, Dickinson, ND (US)

(73) Assignee: TGR Construction, Inc., Tempe, AZ (US)

( * ) Notice: Subject to any disclaimer, the term of this patent is extended or adjusted under 35 U.S.C. 154(b) by 377 days.

This patent is subject to a terminal disclaimer.

(21) Appl. No.: 16/858,478

(22) Filed: Apr. 24, 2020

(65) Prior Publication Data

US 2020/0407933 A1 Dec. 31, 2020

Related U.S. Application Data

(63) Continuation of application No. 16/451,078, filed on Jun. 25, 2019, now Pat. No. 10,633,812.

(51) Int. Cl.

| | |
|---|---|
| ***E04H 17/00*** | (2006.01) |
| ***E02B 8/04*** | (2006.01) |
| ***E06B 11/02*** | (2006.01) |

(52) U.S. Cl.

CPC ..... *E02B 8/04* (2013.01); *E04H 17/013* (2021.01); *E06B 11/02* (2013.01); *E06B 11/025* (2013.01)

(58) Field of Classification Search

CPC ... E04H 17/013; E04H 17/1439; E04H 17/16; E04H 17/18; E02B 7/28; E06B 11/025

See application file for complete search history.

(56) References Cited

U.S. PATENT DOCUMENTS

| | | | |
|---|---|---|---|
| 1,629,899 | A | 5/1927 | Wustholz |
| 1,721,816 | A | 7/1929 | Glazer |

(Continued)

FOREIGN PATENT DOCUMENTS

| | | | |
|---|---|---|---|
| DE | 2657111 | A1 | 6/1977 |
| DE | 102012206353 | A1 | 10/2013 |

(Continued)

OTHER PUBLICATIONS http://www.aluminumconcreteforms.com/crane_set_concrete_forms.htm; Wall-Ties & Forms Concrete Big Panel Concrete Forms Website Page.

(Continued)

*Primary Examiner* — Michael P Ferguson
(74) *Attorney, Agent, or Firm* — Neustel Law Offices

(57) ABSTRACT

A bollard wall gate system including a lockable access door enclosing the gate which is easy-to-operate and resistant to tampering. The bollard wall gate system generally includes one or more bollard panels which form a continuous bollard wall. Each of the bollard panels includes a passageway which may be selectively opened or closed by use of a gate. The gate includes a plurality of gate members which may be raised to open the gate or lowered to close the gate. The bollard panels include an enclosure through which the gate extends. A locking device may be utilized to selectively lock the gate in its opened or closed position, with the locking device being connected to the gate within the enclosure so as to prevent tampering or unauthorized access.

12 Claims, 18 Drawing Sheets

(56) References Cited

U.S. PATENT DOCUMENTS

| | | | |
|---|---|---|---|
| 1,925,689 | A | 9/1933 | Dietrich |
| 2,049,916 | A | 8/1936 | Lingle |
| 2,164,592 | A | 7/1939 | Pilj |
| 2,172,461 | A | 9/1939 | Whitescarver |
| 2,173,698 | A | 9/1939 | Schenk |
| 2,373,858 | A | 4/1945 | Solyst |
| 2,395,204 | A | 2/1946 | Symons |
| 2,497,887 | A | 2/1950 | Hilpert |
| 2,614,801 | A | 10/1952 | Mazzei |
| 2,659,125 | A | 11/1953 | Williams |
| 2,717,801 | A | 9/1955 | Neil |
| 2,930,353 | A | 3/1960 | Sievers |
| 3,163,904 | A | 1/1965 | Ziolkowski |
| 3,464,667 | A | 9/1969 | Sledz |
| 3,478,396 | A | 11/1969 | Drouillard |
| 3,635,613 | A | 1/1972 | Marsh |
| 3,676,031 | A | 7/1972 | Stinton |
| 3,687,597 | A | 8/1972 | Lavergne |
| 3,693,931 | A | 9/1972 | Holt |
| 3,801,061 | A | 4/1974 | Holt |
| 3,833,706 | A | 9/1974 | Edwards |
| 3,844,697 | A | 10/1974 | Edwards |
| 3,910,546 | A | 10/1975 | Connors |
| 3,954,189 | A | 5/1976 | Sherritt |
| 3,965,542 | A | 6/1976 | Gregory |
| 4,003,543 | A | 1/1977 | Doubleday |
| 4,006,878 | A | 2/1977 | Dawson |
| 4,023,771 | A | 5/1977 | Walchek |
| 4,044,986 | A | 8/1977 | Strickland |
| 4,098,045 | A | 7/1978 | Astor |
| 4,158,452 | A | 6/1979 | Gates |
| 4,186,906 | A | 2/1980 | Koga |
| 4,192,481 | A | 3/1980 | Durbin |
| 4,218,039 | A | 8/1980 | Gates |
| 4,221,357 | A | 9/1980 | Bowden |
| 4,231,541 | A | 11/1980 | Strickland |
| 4,254,932 | A | 3/1981 | Durbin |
| 4,290,246 | A | 9/1981 | Hilsey |
| 4,314,775 | A | 2/1982 | Johnson |
| 4,405,262 | A | 9/1983 | Nagashima |
| 4,417,425 | A | 11/1983 | Case |
| 4,441,685 | A | 4/1984 | Greeson |
| 4,481,743 | A | 11/1984 | Jellen |
| 4,611,784 | A | 9/1986 | Gallis |
| 4,671,724 | A | 6/1987 | Bolton |
| 4,676,713 | A | 6/1987 | Voelpel |
| 4,700,979 | A | 10/1987 | Courtois |
| 4,708,315 | A | 11/1987 | Carlson |
| 4,726,562 | A | 2/1988 | Courtois |
| 4,795,136 | A | 1/1989 | Haefner |
| 4,807,843 | A | 2/1989 | Courtois |
| 4,812,113 | A | 3/1989 | Jantzen |
| 4,846,433 | A | 7/1989 | Courtois |
| 4,899,978 | A | 2/1990 | Gates |
| 4,927,317 | A | 5/1990 | Acosta |
| 5,050,365 | A | 9/1991 | Edgar |
| 5,073,077 | A | 12/1991 | Altman |
| RE33,881 | E | 4/1992 | Courtois |
| 5,114,294 | A | 5/1992 | Attman |
| 5,127,791 | A | 7/1992 | Attman |
| 5,224,808 | A | 7/1993 | Macris |
| 5,351,456 | A | 10/1994 | Paine, Jr. |
| 5,364,050 | A | 11/1994 | Smith |
| 5,441,379 | A | 8/1995 | Gilbert, Jr. |
| 5,537,797 | A | 7/1996 | Harkenrider |
| 5,624,222 | A | 4/1997 | Hiatt |
| 5,643,488 | A | 7/1997 | Lee |
| 5,778,594 | A | 7/1998 | Askins |
| 5,799,399 | A | 9/1998 | Schultz |
| 5,857,296 | A | 1/1999 | Niday |
| 5,922,236 | A | 7/1999 | Zuhl |
| 5,956,922 | A | 9/1999 | Liuska |
| 6,481,156 | B1 | 11/2002 | Richmond |
| 6,513,785 | B1 | 2/2003 | Worley |
| 6,523,323 | B2 | 2/2003 | Worley |
| 6,729,079 | B2 | 5/2004 | Francies, III |
| 6,755,385 | B2 | 6/2004 | Lancelot, III |
| 6,883,463 | B2 | 4/2005 | Link |
| 6,935,607 | B2 | 8/2005 | Ward |
| 7,004,443 | B2 | 2/2006 | Bennett |
| 7,051,988 | B2 | 5/2006 | Shaw |
| 7,222,460 | B2 | 5/2007 | Francies, III |
| 7,775,500 | B1 | 8/2010 | Vegsund |
| 7,819,388 | B2 | 10/2010 | McCallion |
| 7,828,263 | B2 | 11/2010 | Bennett |
| 7,874,053 | B2 | 1/2011 | Stangel |
| 8,186,645 | B2 | 5/2012 | Shaw |
| 8,317,502 | B1 | 11/2012 | Grey |
| 8,464,996 | B2 | 6/2013 | Spindler |
| 9,033,619 | B2 | 5/2015 | Riggle, Jr. |
| 9,212,462 | B2 | 12/2015 | Borel |
| 9,297,179 | B2 | 3/2016 | Smith |
| 9,347,231 | B2 | 5/2016 | Cormier |
| 9,988,823 | B1 | 6/2018 | Fisher |
| 10,633,812 | B1 * | 4/2020 | Fisher ..... E02B 8/04 |
| 2003/0057747 | A1 | 3/2003 | Johnston |
| 2004/0218997 | A1 | 11/2004 | Neubauer |
| 2005/0218291 | A1 | 10/2005 | Musk |
| 2005/0220597 | A1 | 10/2005 | Burkett |
| 2006/0062655 | A1 | 3/2006 | Harrelson |
| 2006/0242921 | A1 | 11/2006 | Massie |
| 2007/0234643 | A1 | 10/2007 | Siegal |
| 2008/0050213 | A1 | 2/2008 | Kundel |
| 2009/0107065 | A1 | 4/2009 | LeBlang |
| 2009/0267320 | A1 | 10/2009 | Phillips |
| 2010/0064572 | A1 | 3/2010 | Kurachi |
| 2011/0305529 | A1 | 12/2011 | Riggle, Jr. |
| 2012/0043865 | A1 | 2/2012 | Newkirk |
| 2013/0020732 | A1 | 1/2013 | Jentsch |
| 2013/0248680 | A1 | 9/2013 | Fergeson |
| 2013/0269284 | A1 | 10/2013 | Hovenier |
| 2015/0052839 | A1 | 2/2015 | Rice |
| 2015/0081178 | A1 | 3/2015 | Billaud |
| 2016/0201408 | A1 | 7/2016 | Little |
| 2016/0208515 | A1 | 7/2016 | Larsen |
| 2018/0044983 | A1 | 2/2018 | Prasad |
| 2018/0071949 | A1 | 3/2018 | Giles |
| 2018/0077919 | A1 | 3/2018 | McNew |
| 2018/0112389 | A1 | 4/2018 | Lake |
| 2018/0347213 | A1 | 12/2018 | Clevenger |
| 2018/0347227 | A1 | 12/2018 | Neusch |
| 2019/0032339 | A1 | 1/2019 | Matturro |

FOREIGN PATENT DOCUMENTS

| | | | |
|---|---|---|---|
| EP | 2841174 | B1 | 3/2015 |
| EP | 3179010 | A1 | 6/2017 |
| FR | 2951149 | B1 | 4/2011 |
| FR | 3032953 | B1 | 8/2016 |
| FR | 3045692 | A1 | 6/2017 |
| SU | 903530 | A1 | 2/1982 |

OTHER PUBLICATIONS http://www.aluminumconcreteforms.com/concrete_forming_systems.htm; Wall-Ties & Forms Concrete Forming Systems and Formwork Website Page.

http://www.daytonsuperior.com/search#?sections=products&productlines=forming; Dayton Product Search Website Page.

Dayton Forming Accessories Handbook.

Dayton Rapid Ciamp System Manual.

Dayton Steel Ply System Manual.

Harsco LOGIK Forming System Manual.

PCT International Search Report and Written Opinion for PCT Application PCT/US2018/20499.

PCT International Search Report and Written Opinion for PCT application PCT/US2018/062473.

MeadowBurke Sure-Lock Strand Chucks Publication; Oct. 2008.

https://www.nogalesinternational.com/news/bollard-border-fence-draws-good-reviews-on-first-anniversary/article_3c0e21c6-e884-11e1-aedc-001a4bcf887a.html; Aug. 17, 2012.

(56) References Cited

OTHER PUBLICATIONS https://www.nationalreview.com/the-morning-jolt/trumps-great-wall-isnt-whats-being-built/; National Review Website Article Trumps Great Wall Isn't What's Being Built; Dec. 12, 2018.
https://www.businessinsider.com/trump-border-wall-construction-photos-new-mexico-2018-4;Trump Administration Releases New Photos of Border Wall Article; Apr. 11, 2018.
http://theminiaturespage.com/boards/msg.mv?id=452833; The Miniatures Page Message Board Bollard Wall Thread; May 5, 2017.
https://www.youtube.com/watch?v=6NDdYefaHCw; Pivot Flood Gate by Flood Control International YouTube Webpage; Dec. 12, 2017.
https://www.youtube.com/watch?time_continue=1&v=ZVgaNC9MN84; Flood Control International's Lift-Hinge Flood Gate Animation YouTube Webpage; Apr. 11, 2018.
http://www.floodcontrolinternational.com/PRODUCTS/FLOOD-GATES/sliding-floodgate.html; Flood Control International Sliding Flood Gates Data Sheet.
http://www.floodcontrolinternational.com/PRODUCTS/FLOOD-GATES/shg-floodgate.html; Flood Control International Swing-Hinge Flood Gates Data Sheet.
PCT International Search Report and Written Opinion for PCT Application PCT/US2019/38976.

* cited by examiner

BOLLARD WALL GATE SYSTEM

CROSS REFERENCE TO RELATED APPLICATIONS

The present application is a continuation of U.S. application Ser. No. 16/451,078 filed on Jun. 25, 2019 which issues Apr. 28, 2020 as U.S. Pat. No. 10,633,812. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to a bollard wall gate system including a lockable access door enclosing the gate which is easy-to-operate and resistant to tampering.

Related Art

Any discussion of the related art throughout the specification should in no way be considered as an admission that such related art is widely known or forms part of common general knowledge in the field.

Barriers such as walls, fences, and the like have been in the news recently due to conditions at the southern border of the United States. One such type of barrier is commonly referred to as a bollard fence or bollard wall. Such a barrier may comprise bollards that are vertically-oriented and spaced-apart so as to define slots through which one can view the other side of the barrier. These types of barriers are desirable in various situations, such as for use in border walls where it is desired to prevent egress from a certain side while allowing visual contact with that side.

Flood gates are needed in bollard wall designs when the bollard wall panels cross low water washes. These gates are needed during high water events to allow increased water and debris to flow through on a natural basis. Current gate designs have heavy hinged panels that must be unlocked and then swing open to the accessed side. If gates are not opened in timely fashion debris collects against the gates not allowing the side swinging hinged gate to open. Another design uses vertically hoisted panels that require special guide tracks to keep them in alignment and avoid wedging as they are lifted. These require some type of winch or hoist to lift them. Often times the guides or tracks build up with debris and render the gate inoperable.

In both of these designs latches and locking requires detailed installation for the proper function of the locks. The intension of the locks is to eliminate opening of the gates from the non-access side of the bollard fence system.

SUMMARY

An example embodiment is directed to a bollard wall gate system. The bollard wall gate system includes one or more bollard panels which form a continuous bollard wall. Each of the bollard panels includes a passageway which may be selectively opened or closed by use of a gate. The gate includes a plurality of gate members which may be raised to open the gate or lowered to close the gate. The bollard panels include an enclosure through which the gate extends. A locking device may be utilized to selectively lock the gate in its opened or closed position, with the locking device being connected to the gate within the enclosure so as to prevent tampering or unauthorized access.

There has thus been outlined, rather broadly, some of the embodiments of the bollard wall gate system in order that the detailed description thereof may be better understood, and in order that the present contribution to the art may be better appreciated. There are additional embodiments of the bollard wall gate system that will be described hereinafter and that will form the subject matter of the claims appended hereto. In this respect, before explaining at least one embodiment of the bollard wall gate system in detail, it is to be understood that the bollard wall gate system is not limited in its application to the details of construction or to the arrangements of the components set forth in the following description or illustrated in the drawings. The bollard wall gate system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

A. Overview

Figure 1:
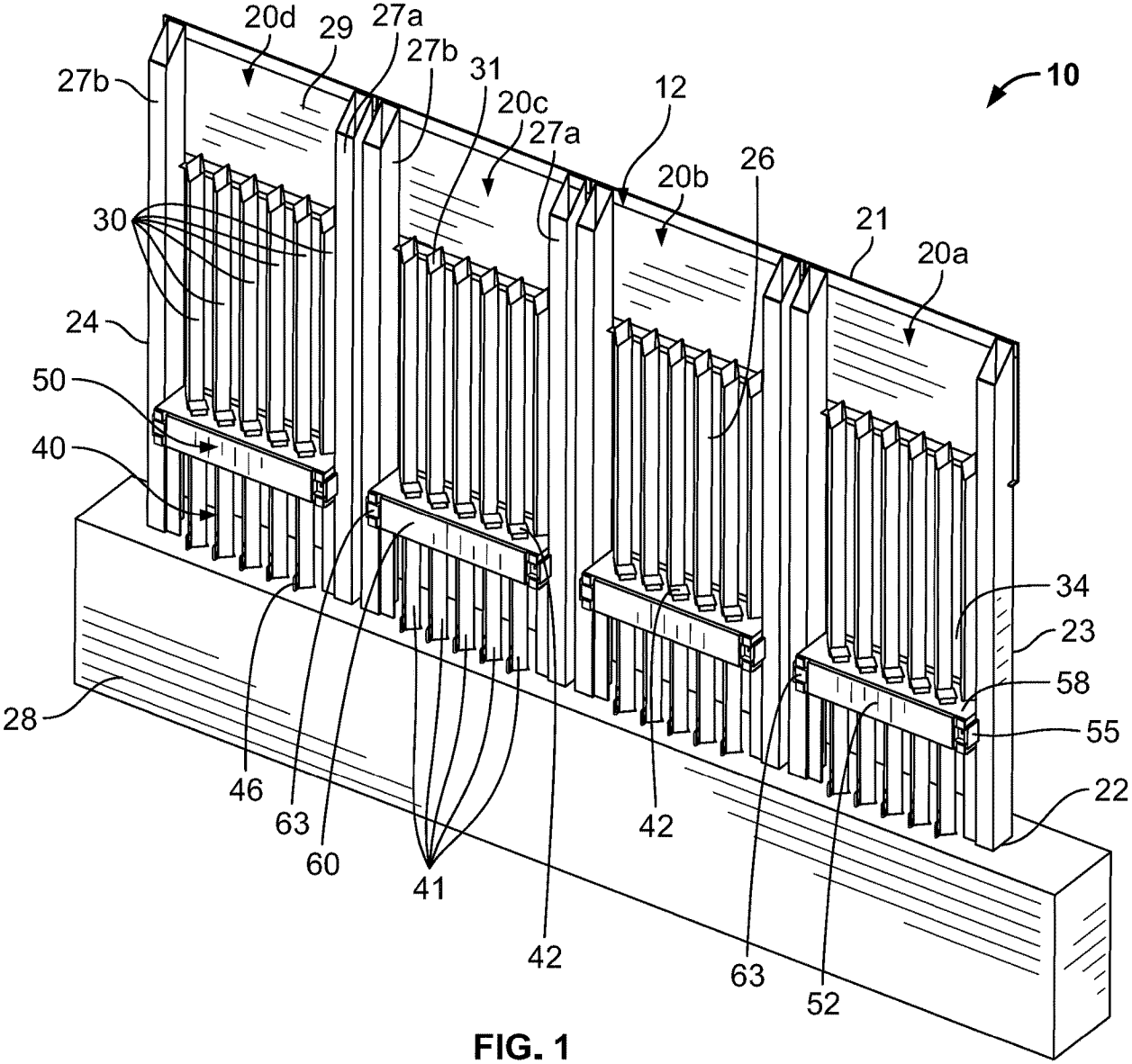
FIG. 1 is a rear perspective view of a bollard wall gate system with all gates in a lowered position in accordance with an example embodiment.

An example bollard wall gate system 10 generally comprises a bollard panel 20*a*, 20*b*, 20*c*, 20*d* comprising an upper end 21, a lower end 22, a first side 23, a second side 24, an inner end 26, an outer end 25, and a passageway 49 between the inner end 26 and the outer end 25. The bollard panel 20*a*, 20*b*, 20*c*, 20*d* comprises a plurality of bollards 30, wherein the plurality of bollards 30 are distally spaced so as to define a plurality of slots 34. An enclosure 50 is connected to the bollard panel 20*a*, 20*b*, 20*c*, 20*d*, wherein a lower end 32 of each of the plurality of bollards 30 is connected to the enclosure 50. A gate 40 is movably connected to the bollard panel 20*a*, 20*b*, 20*c*, 20*d*, the gate 40 being adjustable between an opened position and a closed position. The passageway 49 is blocked by the gate 40 when the gate 40 is in the closed position. The gate 40 may extend through the enclosure 50. A locking device 48 for locking the gate 40 in the raised position or the lowered position is removably connected to the gate 40 within the enclosure 50.

The plurality of bollards 30 may be vertically or substantially vertically oriented between the first and second sides 23, 24 of the bollard panel 20*a*, 20*b*, 20*c*, 20*d*. The enclosure 50 may comprise an upper member 58 such as an upper plate and a lower member 59 such as a lower plate, with each of the plurality of bollards 20*a*, 20*b*, 20*c*, 20*d* being connected to the upper member 58 of the enclosure 50.

The gate 40 may comprise a plurality of gate members 41, each of the gate members 41 comprising an upper end 42 and a lower end 43. Each of the plurality of gate members 41 may comprise an upper receiver 44 and a lower receiver 45, wherein the upper receiver 44 is positioned within the enclosure 50 when the gate 40 is in the closed position and the lower receiver 45 is positioned within the enclosure when the gate 40 is in the opened position.

The locking device 48 may be removably connected to the upper receiver 44 to lock each of the plurality of gate members 41 in the closed position. The locking device 48 may be removably connected to the lower receiver 45 to lock each of the plurality of gate members 41 in the opened position. Each of the plurality of gate members 41 may comprise a tubular member, including various cross-sections including square-shaped, triangular, pentagonal, hexagonal, and the like. Each of the plurality of gate members 41 may be movable within one of the plurality of slots 34 defined by the bollards 30.

Another exemplary embodiment of a bollard wall gate system 10 10 generally comprises a bollard panel 20*a*, 20*b*, 20*c*, 20*d* comprising an upper end 21, a lower end 22, a first side 23, a second side 24, an inner end 26, an outer end 25, and a passageway 49 between the inner end 26 and the outer end 25. The bollard panel 20*a*, 20*b*, 20*c*, 20*d* comprises a plurality of bollards 30, wherein the plurality of bollards 30 are distally spaced so as to define a plurality of slots 34. An enclosure 50 is connected to the bollard panel 20*a*, 20*b*, 20*c*, 20*d*, wherein a lower end 32 of each of the plurality of bollards 30 is connected to the enclosure 50. The enclosure 50 comprises an access door 60 providing access to an interior chamber 54 of the enclosure 50.

A plurality of gate members 41 are movably connected to the bollard panel 20*a*, 20*b*, 20*c*, 20*d*, the gate members 41 each being adjustable between an opened position and a closed position. The passageway 49 is blocked by the gate members 41 when the gate members 41 are in the closed position. Each of the gate members 41 may extend through the enclosure 50. A locking device 48 for locking the gate 40 in the raised position or the lowered position is removably connected to each of the gate members 40 within the enclosure 50.

The lower end 22 of the bollard panel 20*a*, 20*b*, 20*c*, 20*d* may be connected to a ground surface 11, wherein the passageway 49 is defined between the enclosure 50 and the ground surface 11. The lower end 22 of the bollard panel 20*a*, 20*b*, 20*c*, 20*d* may alternatively be connected to a concrete footing 28, wherein the passageway 49 is defined between the enclosure 50 and the concrete footing 28.

The enclosure 50 may comprise an interior chamber 54, wherein each of the plurality of gate members 41 extends through the interior chamber 54. Each of the plurality of gate members 41 may comprise an upper receiver 44 and a lower receiver 45, wherein the upper receiver 44 of each of the plurality of gate members 41 is positioned within the interior chamber 54 of the enclosure 50 when each of the plurality of gate members 41 is in the closed position. The lower receiver 45 of each of the plurality of gate members 41 is positioned within the interior chamber 54 of the enclosure 50 when each of the plurality of gate members 41 is in the opened position. Each of the gate members 41 may be adapted to be raised or lifted within one of the plurality of slots 34. The access door 60 may be hingedly connected to the enclosure by a recessed hinge 63.

B. Bollard Panels

Figure 9:
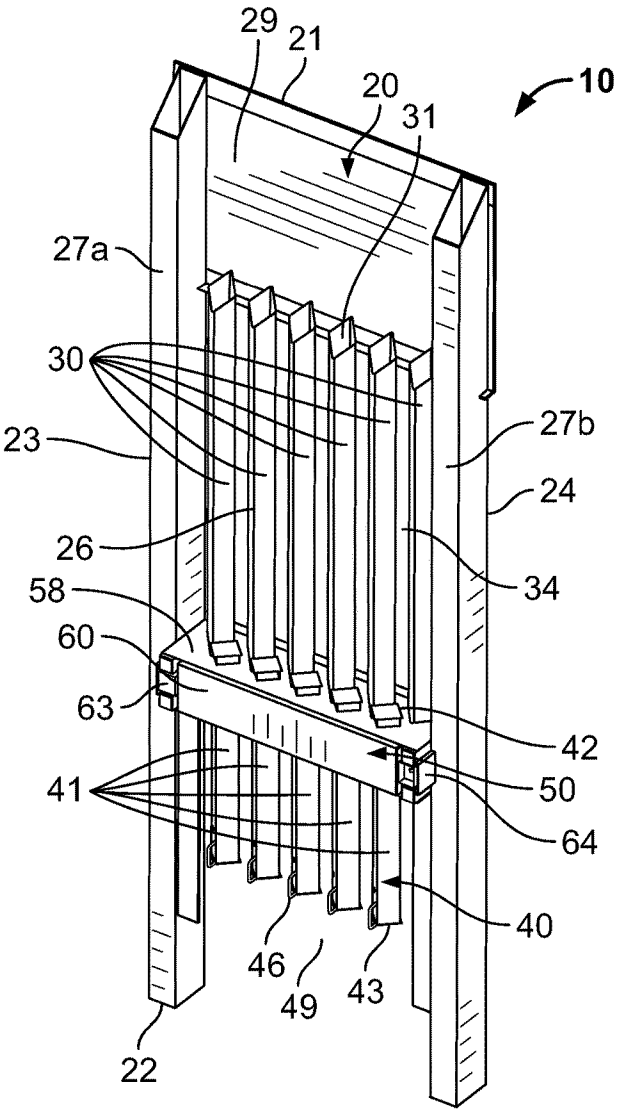
FIG. 9 is a perspective view of a bollard wall gate system including a single bollard panel with the gate in the lowered position in accordance with an example embodiment.

As shown in FIG. 1, one or more bollard panels 20*a*, 20*b*, 20*c*, 20*d* may be either interconnected in series or positioned in the ground surface so as to form a barrier such as a bollard wall 12. The number of bollard panels 20*a*, 20*b*, 20*c*, 20*d* may vary depending on the distance being covered, the size (width) of each bollard panel 20*a*, 20*b*, 20*c*, 20*d*, and other construction considerations. In some embodiments such as shown in FIG. 9, a single bollard panel 20 may be utilized. In other embodiments, a plurality of bollard panels 20*a*, 20*b*, 20*c*, 20*d* may be connected in series or positioned in the ground surface to form the bollard wall 12.

While FIGS. 1-8 illustrate exemplary embodiments in which four bollard panels 20*a*, 20*b*, 20*c*, 20*d* are utilized to form the bollard wall 12, it should be appreciated that more or less bollard panels 20*a*, 20*b*, 20*c*, 20*d* may be utilized in different embodiments. Hundreds or even thousands of the bollard panels 20 may be utilized to extend for large distances.

As shown in FIGS. 1-8, each bollard panel 20*a*, 20*b*, 20*c*, 20*d* which makes up the bollard wall 12 comprises an upper end 21, a lower end 22, a first side 23, and a second side 24. Each of the bollard panels 20*a*, 20*b*, 20*c*, 20*d* is generally positioned in a vertical (or substantially vertical) orientation to extend out of the ground surface.

The bollard panels 20*a*, 20*b*, 20*c*, 20*d* may include a footing 28 such as shown in FIGS. 1-8. The footing 28 may comprise concrete or other materials known to secure walls, fences, or other barriers in an upright orientation in a ground surface. The footing 28 may be completely buried, with the ground surface being above the footing 28 and only the bollard panels 20 being above-grade.

In other embodiments, the footing 28 may extend above-grade so as to form a base for a hybrid wall such as shown and described in U.S. patent application Ser. No. 16/272,859, filed on Aug. 16, 2019 and covering a "Hybrid Wall Installation System", which is hereby incorporated by reference. In such an embodiment, the footing 28 may be partially buried below-grade in the ground surface and partially extend above-grade out of the ground surface. In such embodiments, the lower end 22 of the bollard panels 20 will be above the ground surface.

As best shown in FIGS. 1-11 and 14-17, the upper end 21 of each bollard panel 20 may comprise a sheathing 29 to which the upper end 31 of each of the bollards 30 is connected. The sheathing 29 may comprise a rectangular plate such as shown in the figures. The manner in which the bollards 30 are connected to the sheathing 29 may include, without limitation, welding, fasteners, adhesives, straps, and the like. In some embodiments, the sheathing 29 may be omitted, with the bollards 30 being connected in a vertical, spaced-apart orientation by other methods, such as by use of a horizontal rod extending across the bollards 30 or the like.

Figure 14:
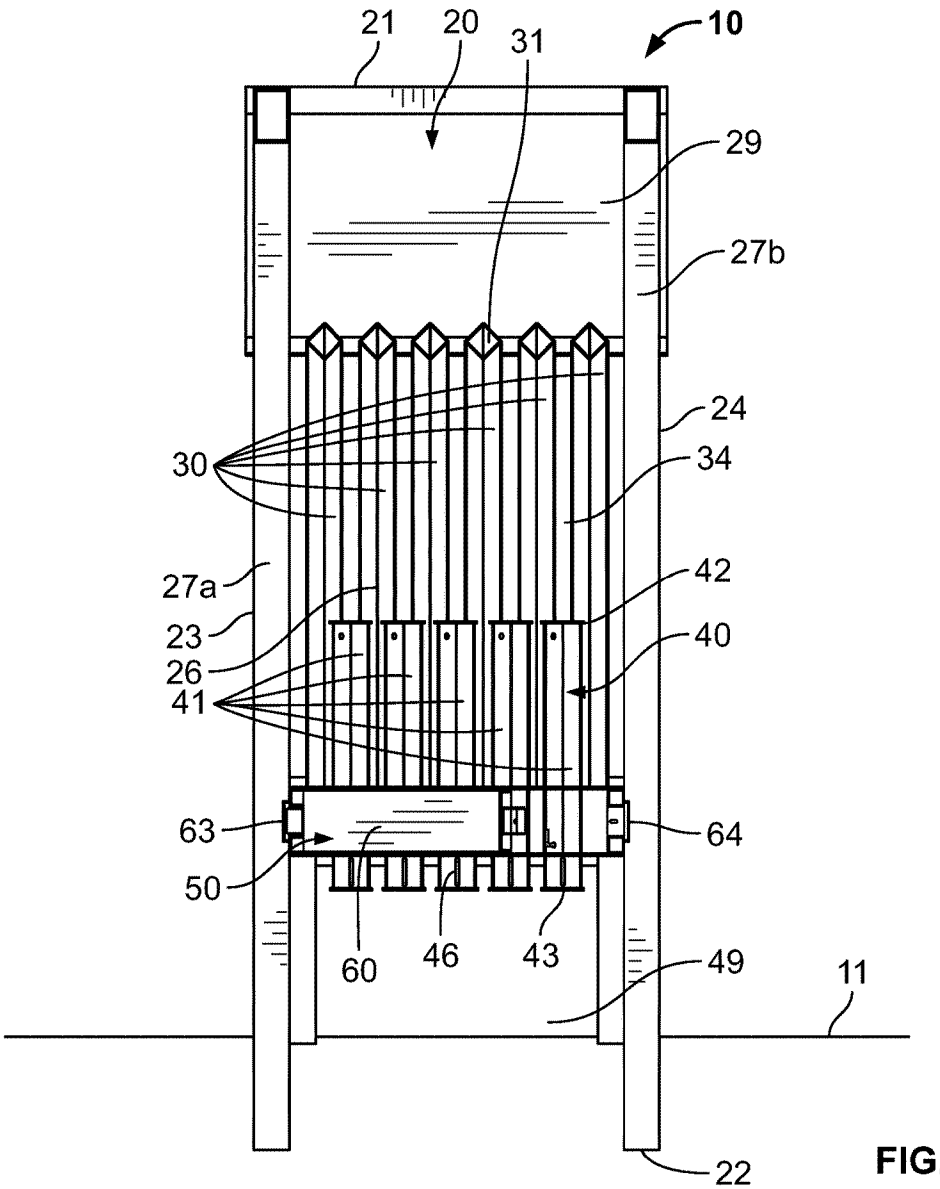
FIG. 14 is a rear view of a bollard wall gate system including a single bollard panel with the gate in the raised position and the access door opened in accordance with an example embodiment.

As shown in FIGS. 1 and 14, each bollard panel 20*a*, 20*b*, 20*c*, 20*d* may include a pair of side members 27*a*, 27*b* which are driven into the ground surface or footing 28. In the exemplary embodiment shown in FIG. 9, a bollard panel 20*a*, 20*b*, 20*c*, 20*d* is illustrated comprising a first side member 27*a* on the first side 23 of the bollard panel 20*a*, 20*b*, 20*c*, 20*d* and a second side member 27*b* on the second side 24 of the bollard panel 20, with each of the side members 27*a*, 27*b* comprising an elongated member such as a tube, rod, pole, post, or the like. In some embodiments, the side members 27*a*, 27*b* may include concrete or rebar for additional reinforcement.

Figure 2:
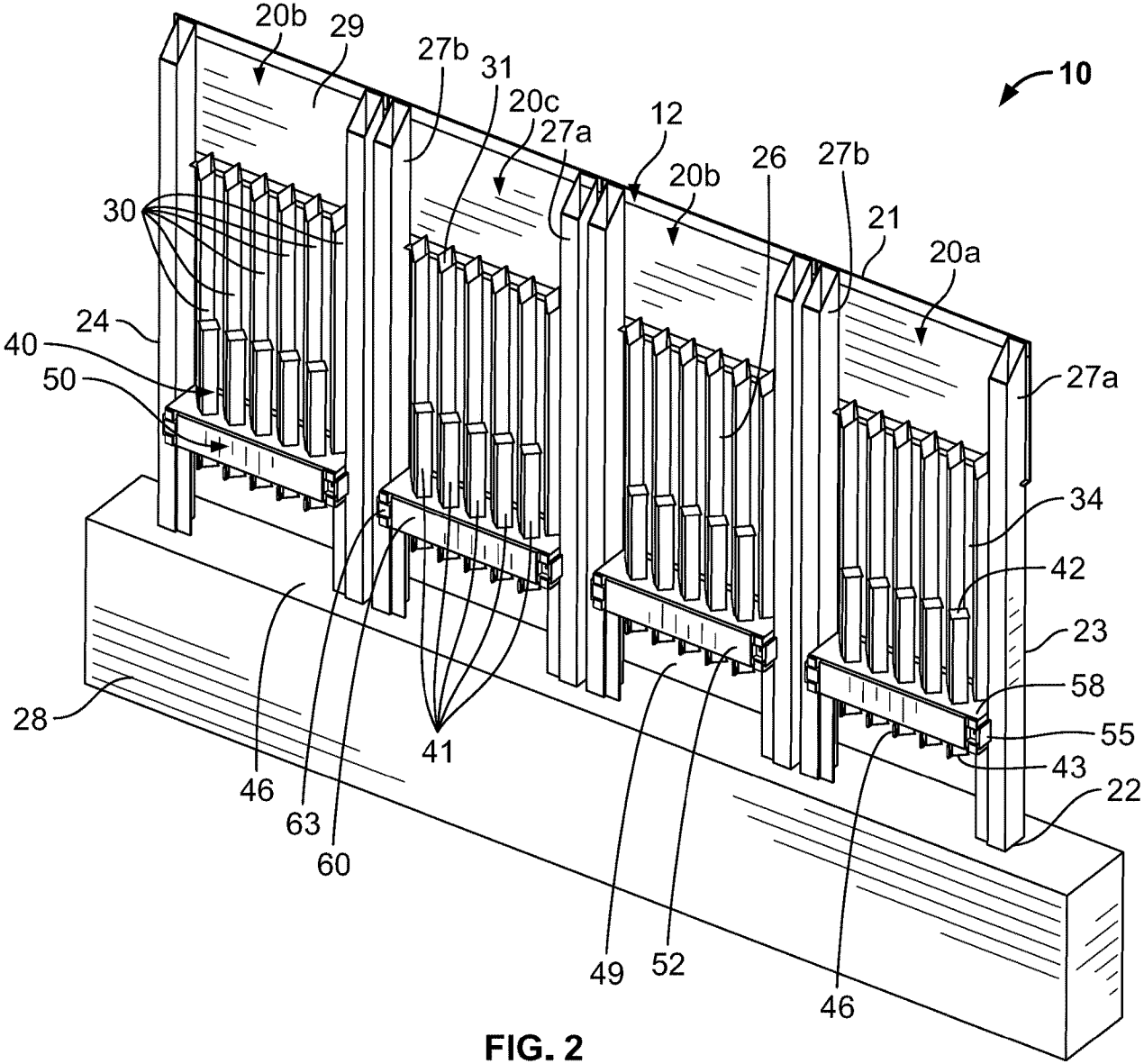
FIG. 2 is a rear perspective view of a bollard wall gate system with all gates in a raised position in accordance with an example embodiment.
Figure 3:
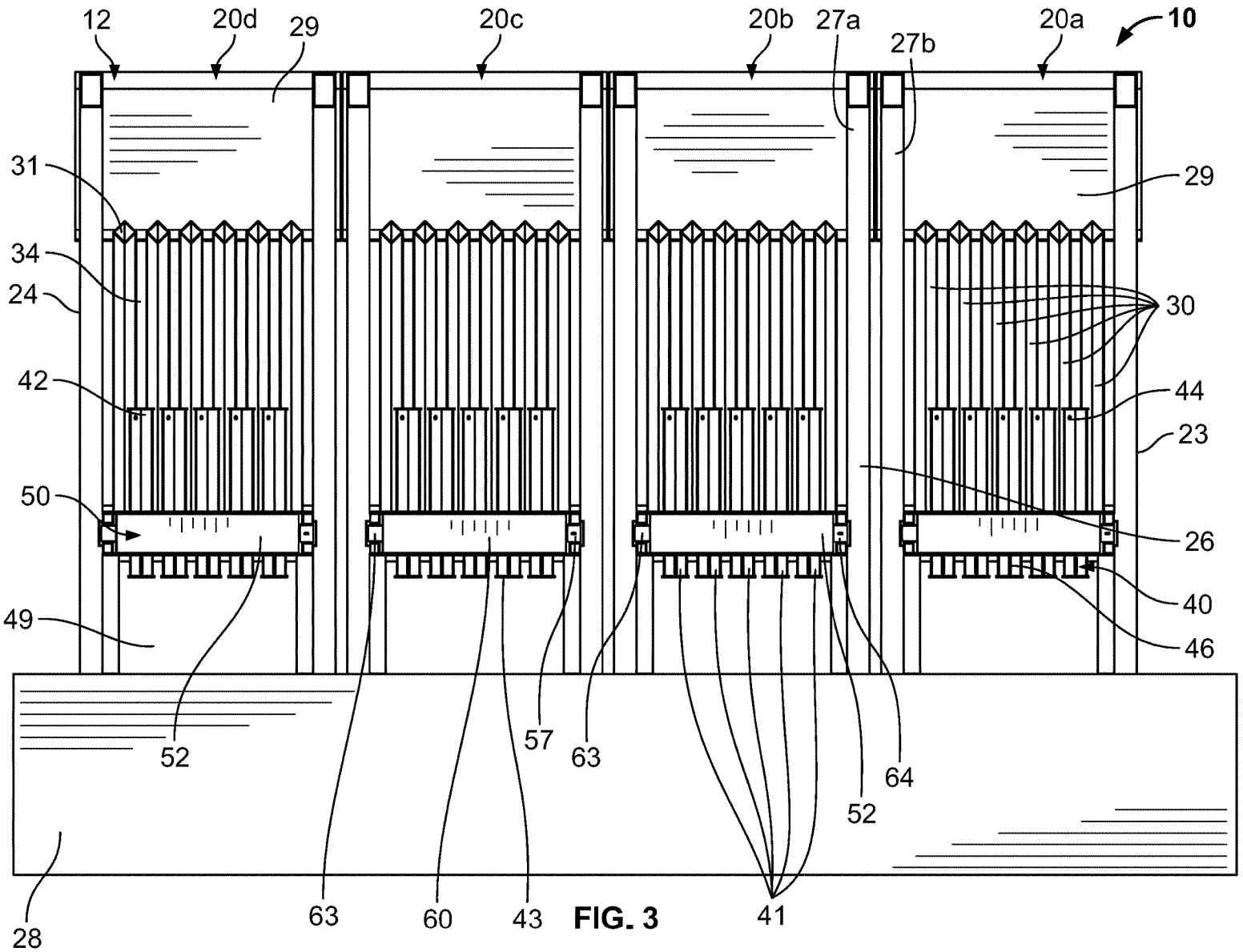
FIG. 3 is a rear view of a bollard wall gate system with all gates in a raised position in accordance with an example embodiment.
Figure 4:
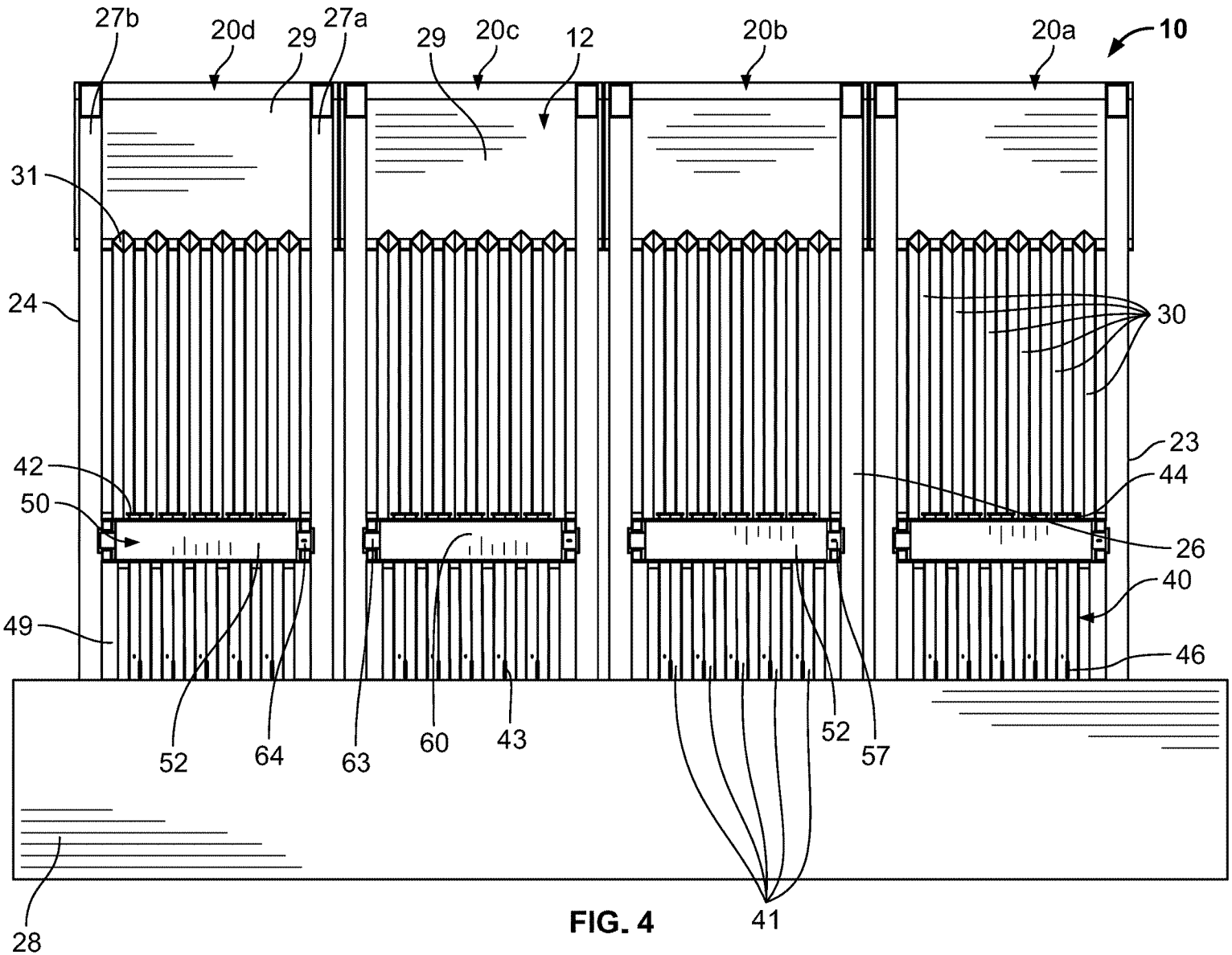
FIG. 4 is a rear view of a bollard wall gate system with all gates in a lowered position in accordance with an example embodiment.

As shown in FIG. 2, the lower end 22 of the bollard panel 20 may be connected to the footing 28 by the side members 27*a*, 27*b*, with the lower ends of the respective side members 27*a*, 27*b* being secured within the footing 28. In other embodiments, the side members 27*a*, 27*b* may be connected directly to the ground surface.

When multiple bollard panels 20*a*, 20*b*, 20*c*, 20*d* are utilized to form a barrier such as a bollard wall 12, the bollard panels 20*a*, 20*b*, 20*c*, 20*d* may be connected to each other or may not be connected directly to each other, but instead positioned so as to abut. In embodiments in which the bollard panels 20*a*, 20*b*, 20*c*, 20*d* are not directly connected to each other, the side members 27*a*, 27*b* of each bollard panel 20 may abut with side members 27*a*, 27*b* of adjacent bollard panels 20 so as to form a continuous barrier.

In embodiments in which the multiple bollard panels 20*a*, 20*b*, 20*c*, 20*d* are connected, the side members 27*a*, 27*b* of each respective bollard panel 20*a*, 20*b*, 20*c*, 20*d* may be connected together, such as by welding, adhesives, clamps, fasteners, and the like. Alternatively, adjacent bollard panels 20 may share side members 27*a*, 27*b*. In such an embodiment, a first bollard panel 20*a* and a second bollard panel 20*b* may share a side member 27*a*, 27*b*, with the second side member 27*b* of the first bollard panel 20*a* also serving as the first side member 27*a* of the second bollard panel 20*b*.

The manner in which the bollard panels 20*a*, 20*b*, 20*c*, 20*d* are installed and secured in the ground surface may vary in different embodiments. An exemplary method of installation is shown and described in U.S. patent application Ser. No. 16/272,859, which has previously been incorporated by reference. In other embodiments, a trench or other opening in the ground surface may be cleared by an excavator, shovel, or other tool. The lower end 22 of each bollard panel 20 may be positioned in the trench or other opening and supported in an upright manner. Concrete may then be poured into the trench of or other opening so as to encapsulate the lower end 22 of each bollard panel 20*a*, 20*b*, 20*c*, 20*d*. The concrete will then cure around the lower end 22 of each bollard panel 20*a*, 20*b*, 20*c*, 20*d* to form the footing 28 (which may be below-grade, above-grade, or a mix of both).

Figure 10:
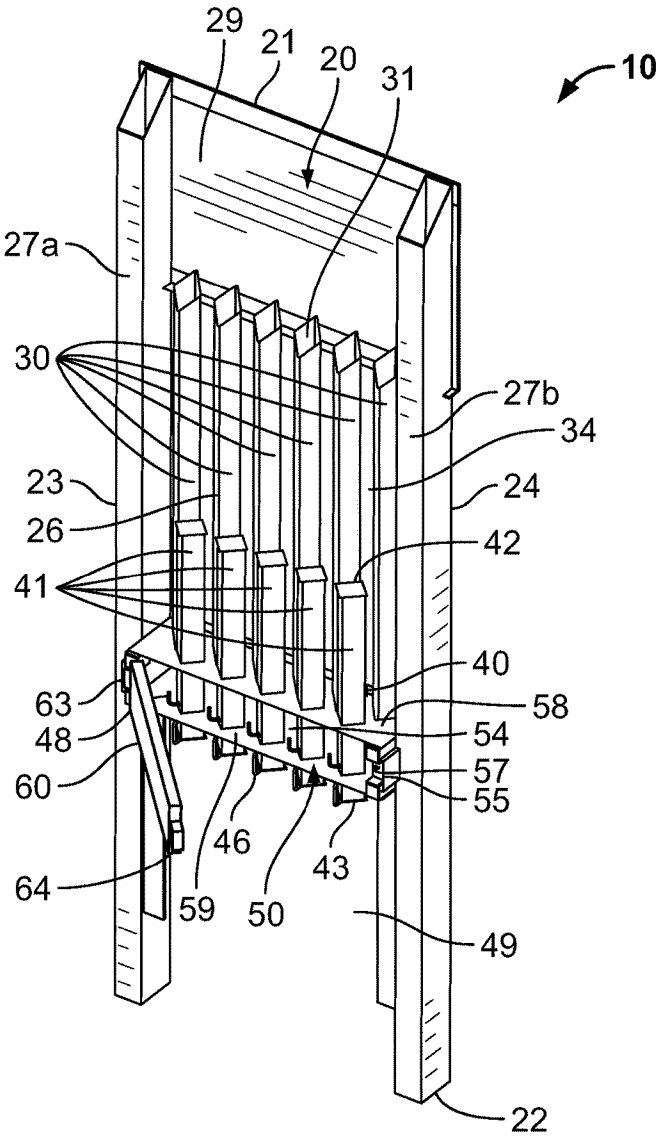
FIG. 10 is a perspective view of a bollard wall gate system including a single bollard panel with the gate in the raised position and the access door opened in accordance with an example embodiment.
Figure 11:
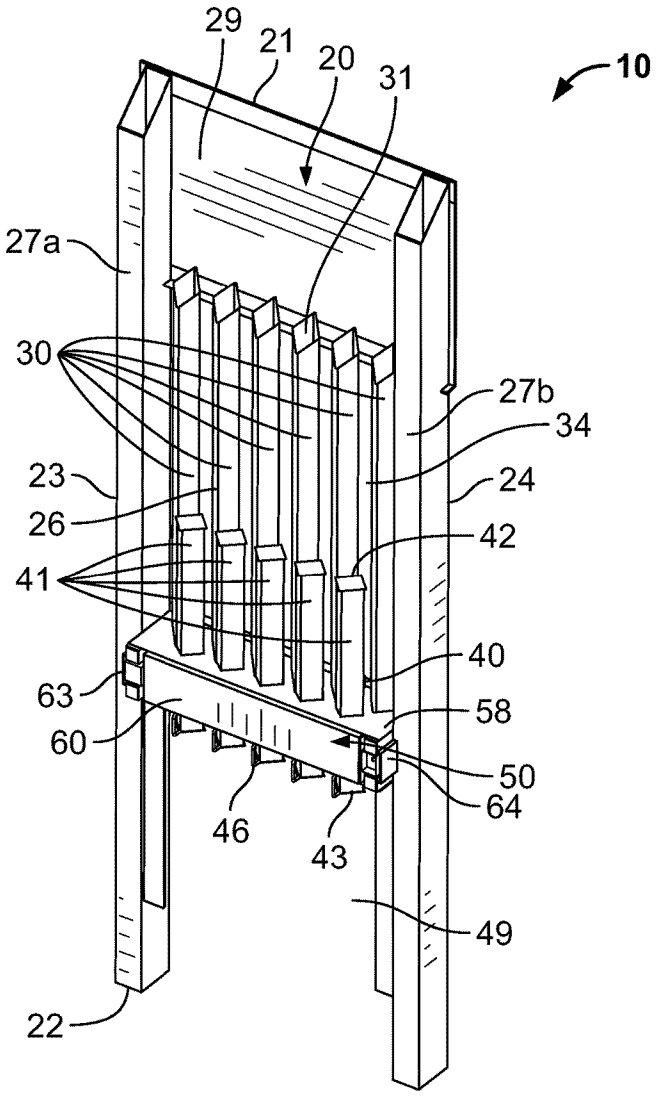
FIG. 11 is a perspective view of a bollard wall gate system including a single bollard panel with the gate in the raised position and the access door locked in a closed position in accordance with an example embodiment.

As shown in FIGS. 9-11, each bollard panel 20*a*, 20*b*, 20*c*, 20*d* comprises a plurality of bollards 30. Each of the bollards 30 comprises an elongated, rigid member such as a rod, pole, post, or the like. While bollards 30 are typically hollow so that they may be filled with concrete, rebar, or other reinforcing structures, it should be appreciated that, in some embodiments of the present invention, the bollards 30 may be solid and not hollow.

As best shown in FIGS. 1-11, each of the bollards 30 comprises an upper end 31 and a lower end 32. In the exemplary figures, the upper end 31 of each bollard 30 is shown as being connected to a sheathing 29. As described previously, the manner in which the upper end 31 of the bollard 30 is connected to the sheathing 29 may vary in different embodiments. Further, the sheathing 29 may be omitted in some embodiments, with other methods being used to maintain the bollards 30 in their desired position and orientation as part of the bollard panel 20*a*, 20*b*, 20*c*, 20*d*.

As shown in FIGS. 2 and 14, the lower end 32 of each bollard 30 is positioned a distance above the ground surface or footing 28 so as to define a passageway 49 which may be selectively opened or closed using the gate 40 as described herein. Thus, the lower end 32 of each bollard 30 is generally suspended above either the ground surface or the footing 28 in embodiments in which the footing 28 extends above-grade.

The distance between the lower end 32 of each bollard 30 and the ground surface or footing 28 may vary in different embodiments depending on the desired height of the passageway 49. In the exemplary embodiment shown in the figures, the passageway 49 extends to approximately the first quarter of the height of the overall bollard panel 20*a*, 20*b*, 20*c*, 20*d*. In other embodiments, the passageway 49 may extend up to a half, or even three-quarters of the height of the overall bollard panel 20*a*, 20*b*, 20*c*, 20*d*.

As shown in the figures, the lower end 32 of each bollard 30 may be secured to or within the enclosure 50. In some embodiments, the lower end 32 of each bollard 30 may extend into an opening formed in the enclosure 50 and secured therein. In other embodiments, the lower end 32 of each bollard 30 may be connected to the top of the enclosure 50, such as by welding, clamps, adhesives, fasteners, or the like. In other embodiments, the lower end 32 of each bollard 30 may be integrally formed with the enclosure 50.

As shown in FIGS. 11-15, each of the bollards 30 is shorter in length than the overall height of the bollard panel 20. While the figures illustrate that the upper ends 31 of the bollards 30 are recessed with respect to (below) the upper end 21 of the bollard panel 20*a*, 20*b*, 20*c*, 20*d*, in some embodiments it should be appreciated that the upper ends 31 of the bollards 30 may extend to the upper end 21 of the bollard panel 20*a*, 20*b*, 20*c*, 20*d*.

The shape, size, number, and orientation of the bollards 30 may vary in different embodiments. In the exemplary embodiments shown in the figures, each bollard panel 20*a*, 20*b*, 20*c*, 20*d* is shown as comprising six vertical, spaced-apart bollards 30. In other embodiments, more or less bollards 30 may be utilized per bollard panel 20*a*, 20*b*, 20*c*, 20*d*.

The height (length) of the bollards 30 may vary in different embodiments to suit different applications. For example, terrain and other considerations may call for different heights for different bollard walls 12 installed in different locations for different purposes. Thus, the height of the bollards 30 should not be construed as limited by the exemplary figures.

Further, although the figures illustrate that the bollards 30 of each bollard panel 20*a*, 20*b*, 20*c*, 20*d* are uniform in length, it should be appreciated that the bollards 30 of a particular bollard panel 20*a*, 20*b*, 20*c*, 20*d* may vary in length in different embodiments. For example, bollards 30 near the first or second side 23, 24 of a bollard panel 20*a*, 20*b*, 20*c*, 20*d* may be longer than bollards 30 which are centrally located between the sides 23, 24 of the bollard panel 20*a*, 20*b*, 20*c*, 20*d*.

In the exemplary embodiments shown in the figures, the bollards 30 are illustrated as being spaced-apart so as to define slots 34 between adjacent bollards 30. Such a configuration allows for individuals to view through the bollard panel 20 to see the other side. The spacing of the bollards 30, and thus the width of the slots 34, may vary in different embodiments to suit different applications. For example, a bollard wall 12 meant to prevent passage of cattle may allow for wider slots 34 between its bollards 30 than a bollard wall 12 meant to prevent passage of humans.

In the exemplary figures, each of the bollards 30 is illustrated as extending vertically. It should be appreciated that, in some embodiments, the bollards 30 may extend at different angles, such as diagonally or even horizontally. Thus, the scope of the present invention should not be construed as limiting with respect to the exemplary vertical orientation shown in the figures.

Figure 12:
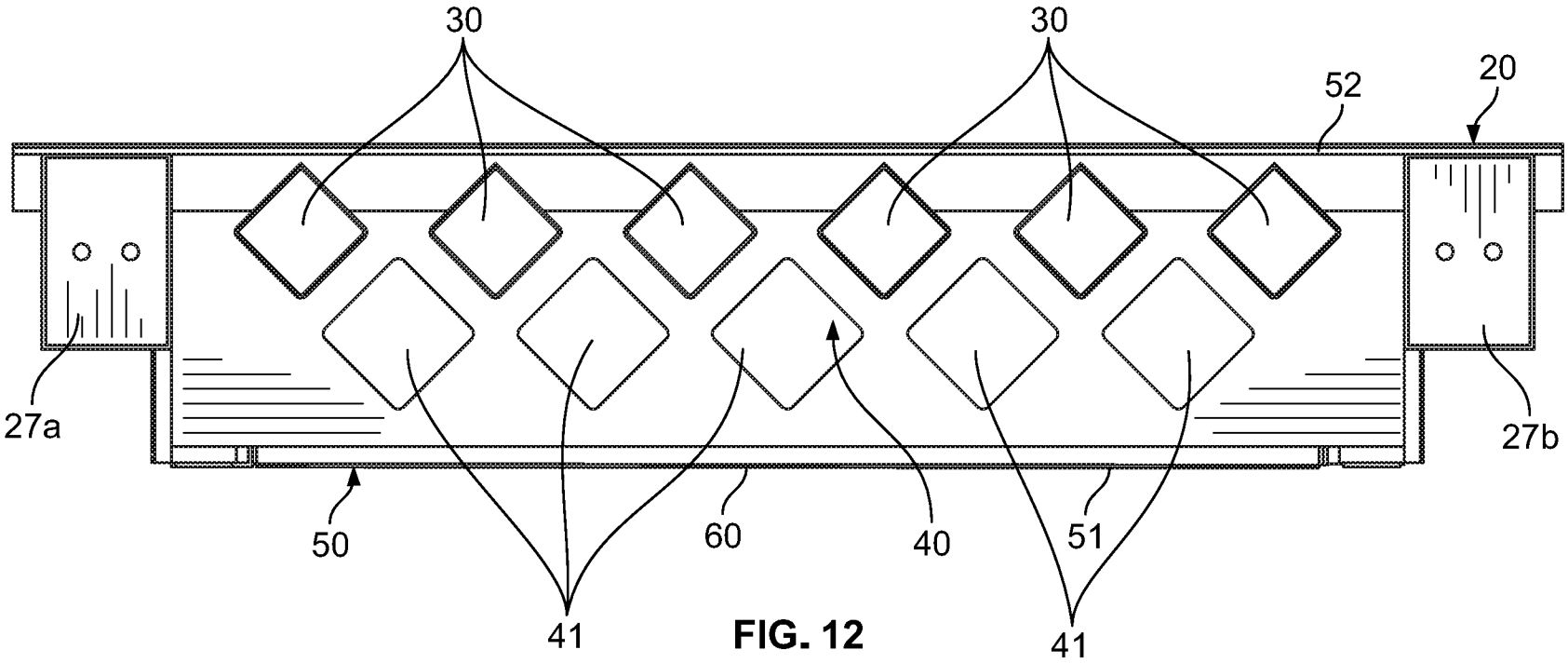
FIG. 12 is a top view of a bollard wall gate system with the access door closed in accordance with an example embodiment.
Figure 13:
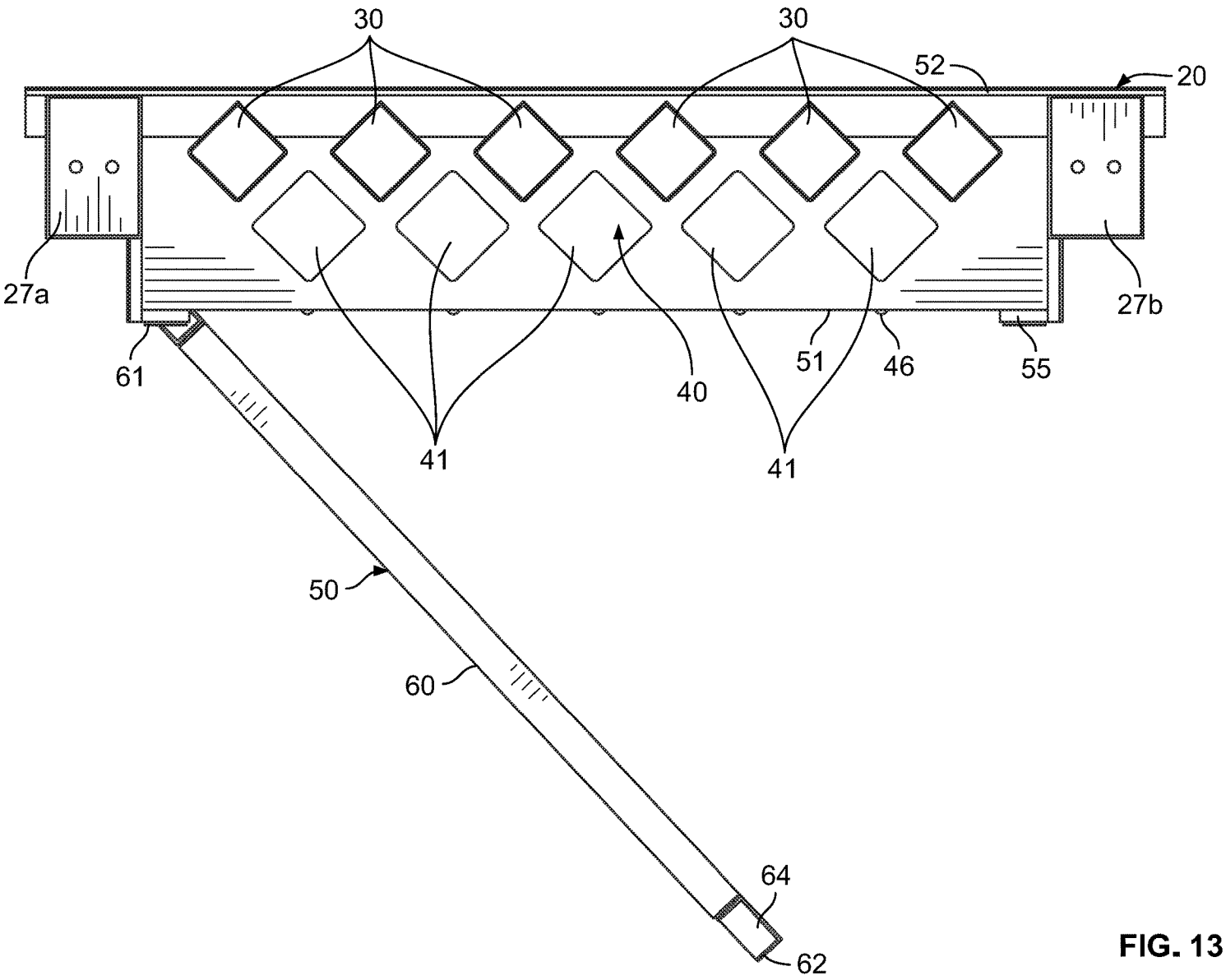
FIG. 13 is a top view of a bollard wall gate system with the access door opened in accordance with an example embodiment.

The shape of the bollards 30 may also vary in different embodiments. In the exemplary embodiments shown in the figures, the bollards 30 are illustrated as comprising a diamond-shaped or square-shaped cross-section as best shown in FIGS. 12 and 13. Such a configuration creates substantially triangular slots between adjacent bollards 30 as shown in FIG. 9.

It should be appreciated that other cross-sections could be utilized for the bollards 30, such as but not limited to circular, triangular, square-shaped, rectangular, and the like. Thus, the scope of the present invention should not be construed as limited by the exemplary diamond-shaped cross-section embodiment shown in the figures.

C. Gate

As shown throughout the figures, each of the bollard panels 20*a*, 20*b*, 20*c*, 20*d* includes a passageway 49. The passageway 49 may be positioned at or near the lower end 22 of the bollard panel 20*a*, 20*b*, 20*c*, 20*d*. In some embodiments, the passageway 49 may be positioned at other locations on the bollard panels 20*a*, 20*b*, 20*c*, 20*d*, such as near the mid-point or near the upper end 21. The passageway 49 may be opened when it is desired to allow passage through the bollard panels 20*a*, 20*b*, 20*c*, 20*d*. For example, during flooding, it may be preferable to open up the passageway 49 to allow debris and the like to freely pass through the bollard panels 20*a*, 20*b*, 20*c*, 20*d*.

Each of the passageways 49 may be selectively opened or closed by use of a gate 40 as shown in FIGS. 1-11. The gate 40 is movably connected to the bollard panel 20*a*, 20*b*, 20*c*, 20*d* such that the gate 40 may be adjusted between an opened position, in which the passageway is exposed, and a closed position, in which the passageway is covered.

In the exemplary embodiment shown in the figures, the gate 40 may be raised into the opened position and lowered into the closed position. However, it should be appreciated that the gate 40 could be adjusted in different manners, such as side-to-side movement. While the figures illustrate that the gates 40 are slidably adjustable, it should be appreciated that they could be rotatably adjustable in some embodiments, such as with a hinge.

The shape, structure, and configuration of the gate 40 may vary in different embodiments. In the exemplary embodiment shown in FIGS. 1-11, each gate 40 is comprised of a plurality of gate members 41. Each of the gate members 41 is illustrated as comprising an elongated member, such as a rod, tube, bollard, slat, pole, post, or the like. When lowered, the gate members 41 prevent passage through the passageway 49. When raised, the gate members 41 expose the passageway 49 to allow passage therethrough.

In the exemplary embodiment of the figures, the gate members 41 are individually adjustable such that one of a plurality of gate members 41 may be raised, with the remaining gate members 41 being kept in a lowered position. In such an embodiment, the area of the passageway 49 which is exposed may be adjusted depending on the number of gate members 41 which are raised or lowered. For example, all gate members 41 may be raised if the entire passageway 49 is desired to be exposed. Alternatively, in situations in which only part of the passageway 49 is needed, only some, but not all, of the gate members 41 may be raised.

Figure 15:
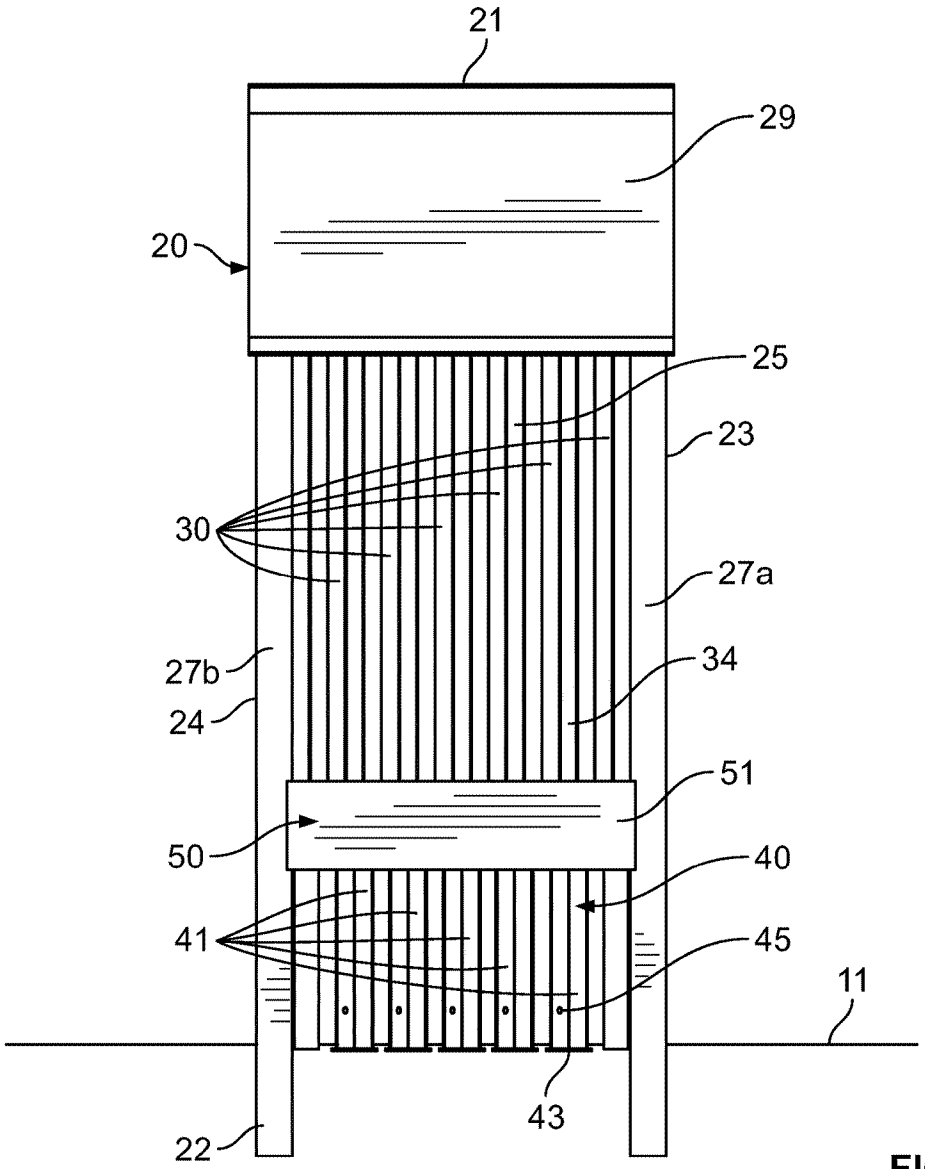
FIG. 15 is a front view of a bollard wall gate system including a single bollard panel with the gate in the lowered position in accordance with an example embodiment.
Figure 16:
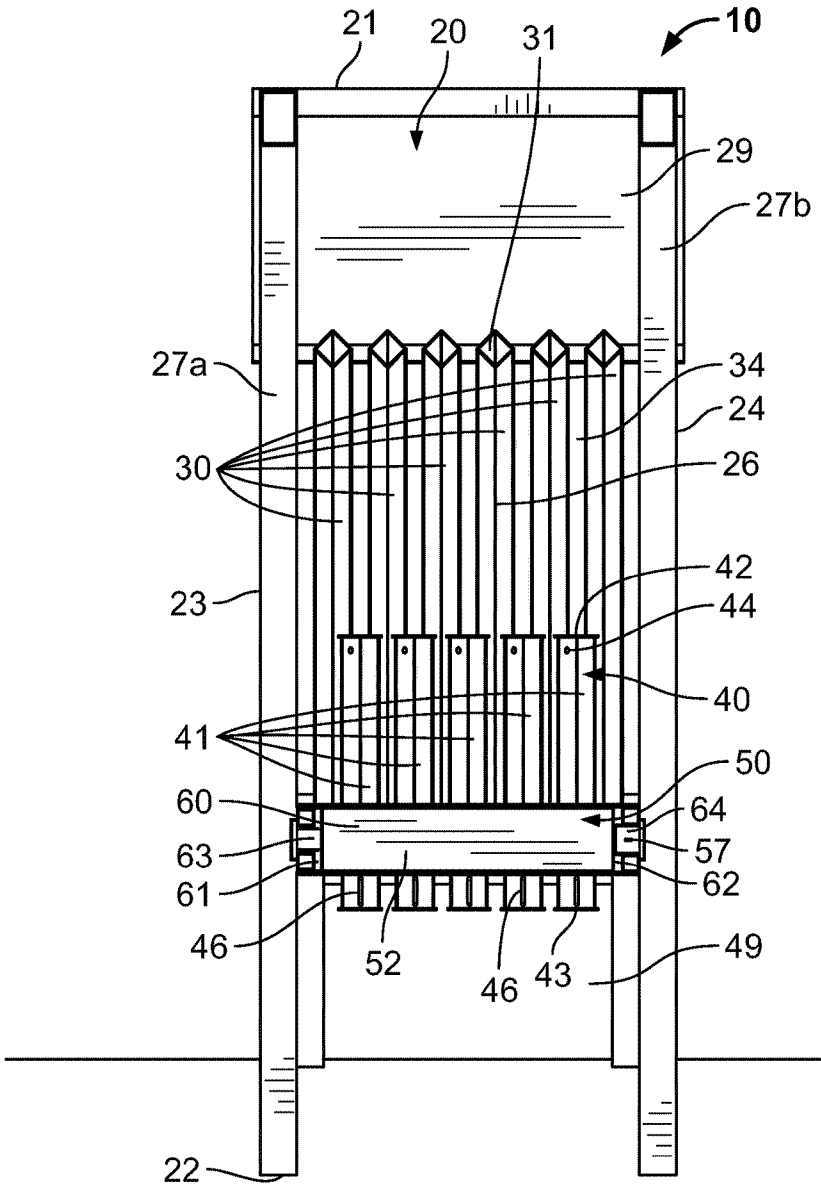
FIG. 16 is a rear view of a bollard wall gate system including a single bollard panel with the gate in the raised position and the access door closed in accordance with an example embodiment.
Figure 17:
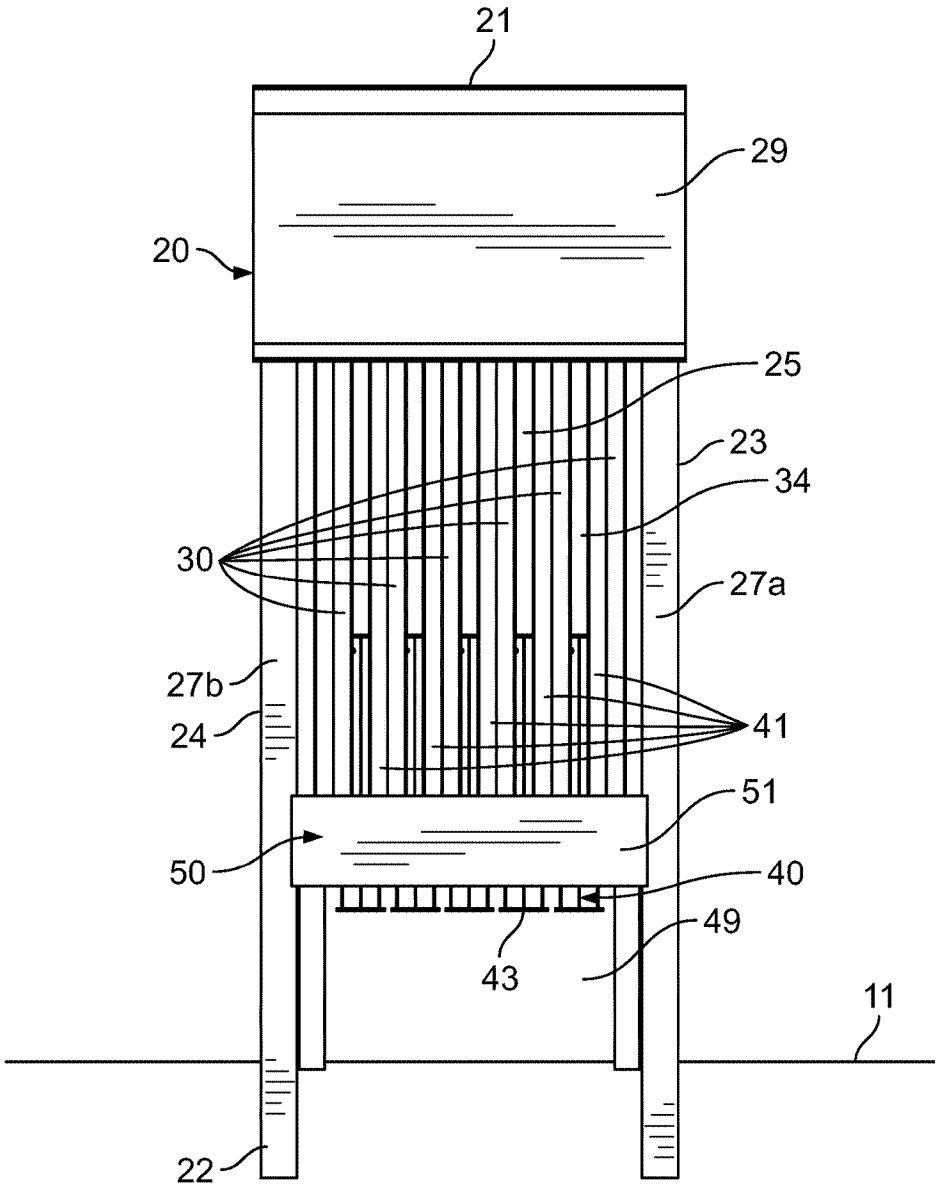
FIG. 17 is a front view of a bollard wall gate system including a single bollard panel with the gate in the raised position in accordance with an example embodiment.

As best shown in FIGS. 9-11, each of the gate members 41 comprises an upper end 42 and a lower end 43. When the gate members 41 are in a lowered position such as shown in FIGS. 1 and 15, the lower end 43 of any lowered gate members 41 will be in contact with the ground surface or footing 28 and the upper end 42 of each gate member 41 will be at the same level as or above the enclosure 50. When the gate members 41 are in a raised position such as shown in FIGS. 2 and 9, the lower end 43 of any raised gate members 41 is positioned above the ground surface or footing 28 so as to expose part of the passageway 49 and the upper end 42 of each gate member 41 will be above the upper end of the enclosure 50.

Figure 18:
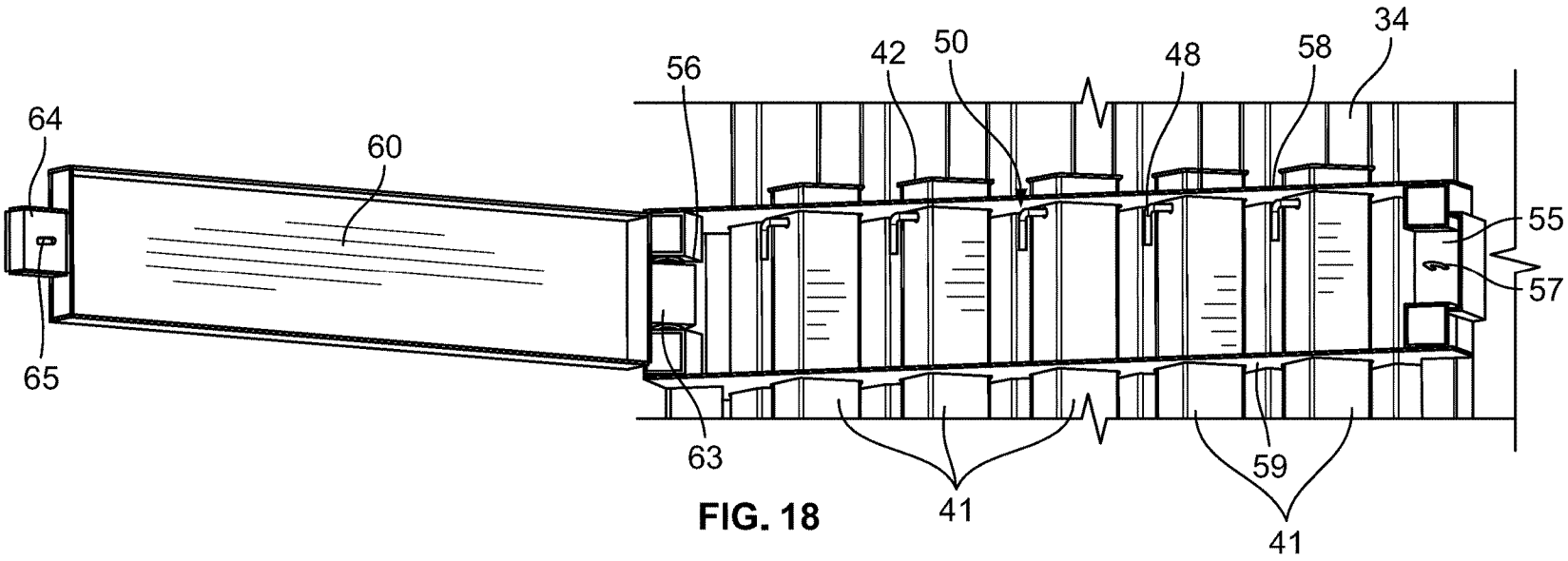
FIG. 18 is a perspective view of an enclosure of a bollard wall gate system with the access door opened and the gate in the lowered position in accordance with an example embodiment.
Figure 19:
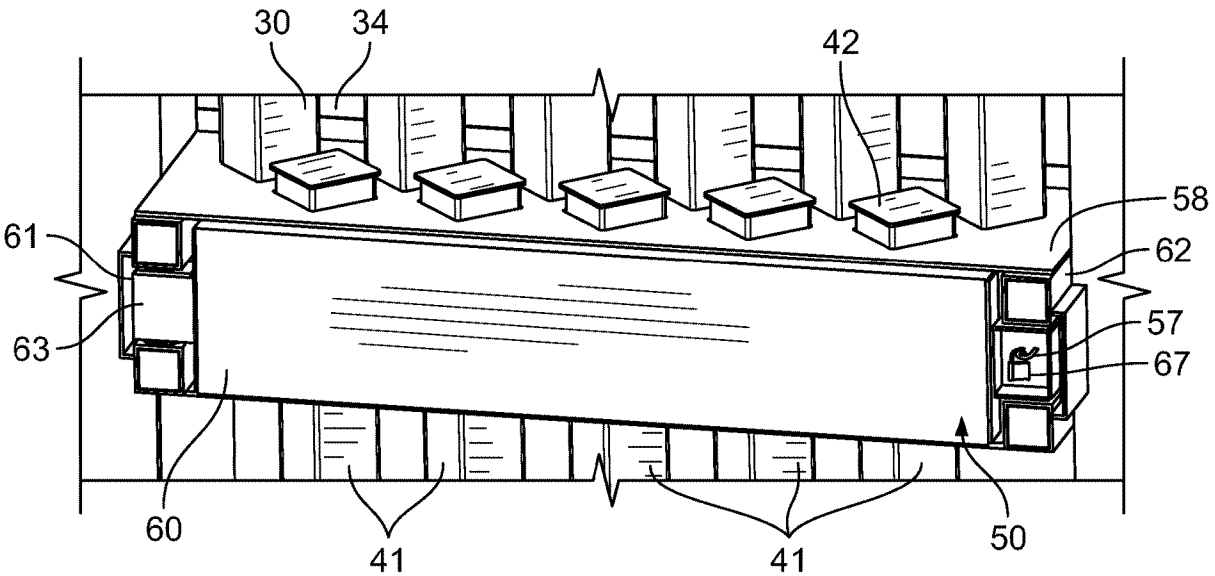
FIG. 19 is a perspective view of an enclosure of a bollard wall gate system with the access door closed and locked and the gate in the lowered position in accordance with an example embodiment.

As shown in FIGS. 18 and 19, each of the gate members 41 extends through the interior chamber 54 of the enclosure 50. In the exemplary figures, the enclosure 50 includes openings which are shaped to match the cross-section of the gate members 41, with the gate members 41 being adjustable by sliding within the openings of the enclosure 50.

By utilizing openings in the enclosure 50 which match the shape of the cross-section of the gate members 41, the gate members 41 will be prevented from rotating (except in the case of a circular opening being used with a cylindrical gate member 41). Additionally, a snug fit between the outer circumference of the gate members 41 and the inner circumference of the openings in the enclosure 50 prevents gaps or other types of opening through which unauthorized individuals may access the interior chamber 54 of the enclosure 50 when the access door 60 is closed.

As shown in FIGS. 9-11, the gate members 41 may include a handle 46 which is adapted to be grasped by an operator to raise or lower the gate members 41. In the exemplary embodiment shown in the figures, each of the gate members 41 includes its own handle 46 so that the individual gate members 41 of the gate 40 may be selectively raised or lowered. In alternate embodiments, the gate members 41 may be interconnected, such as by a horizontal linkage or the like, such that they all are raised or lowered together. In such an embodiment, a single handle 46 may be utilized for all of the gate members 41 of a gate 40. As a further example, the handle 46 could itself extend across and interconnect the gate members 41 of a gate 40.

The positioning and shape of the handle 46 may vary in different embodiments. In the exemplary embodiment shown in the figures, each handle 46 is positioned near the lower end 43 of each gate member 41 such that the handle 46 is always outside of the enclosure 50 regardless of whether the gate member 41 is raised or lowered. The handle 46 may comprise a looped or U-shaped member such as shown in the figures, with the handle 46 abutting against the lower end of the enclosure 50 when the gate member 41 is raised such as shown in FIG. 10.

As shown in FIGS. 9-11, the gate 40 is adapted to be locked into either of its positions such that individuals are unable to open or close the gate 40 without access to the interior chamber 54 of the enclosure 50. Such a configuration may be utilized where it is desired to restrict unauthorized adjustment of the gate 40, such as in the case of a bollard wall 12 along a border between two countries. In the exemplary embodiment shown in the figures, each of the gate members 41 of each gate 40 is individually lockable in either the raised or lowered position.

As shown in FIGS. 9-11, 18, and 19, each of the gate members 41 of a gate 40 may be locked into position using one of a pair of receivers 44, 45 in connection with a locking device 48. In the exemplary embodiment shown in the figures, each gate member 41 comprises an upper receiver 44 at or near the upper end 42 of the gate member 41 and a lower receiver 45 at or near the lower end 43 of the gate member 41.

Each of the receivers 44, 45 may comprise an opening in the gate member 41 which is adapted to selectively receive and engage with a removable locking device 48. The shape, number, positioning, and orientation of receivers 44, 45 on each gate member 41 may vary in different embodiments. While the figures illustrate upper and lower receivers 44, 45, it should be appreciated that one or both receivers 44, 45 may be centrally-located on a gate member 41 in various embodiments.

As best shown in FIGS. 18 and 19, the locking device 48 may comprise a hex key (also known as an Allen wrench). In other embodiments, the locking device 48 may comprise other types of pins, fasteners, or the like. As shown throughout the figures, the locking device 48 may be selectively and removably inserted into one of the receivers 44, 45 of the gate members 41 to lock the gate members 41 in the raised or lowered position.

As shown in FIGS. 18 and 19, when the gate member 41 is in the lowered position, the locking device 48 is inserted into the upper receiver 44. When the locking device 48 is inserted into the upper receiver 44, the gate member 41 will be locked in the lowered position. If a person were to attempt to raise the lowered gate member 41 when the locking device 48 is inserted into the upper receiver 44, the locking device 48 would abut against the upper plate 58 of the enclosure 50 and thus prevent the gate member 41 from being raised such as shown in FIG. 18.

As shown in FIG. 10, when the gate member 41 is in the raised position, the locking device 48 is inserted into the lower receiver 45. When the locking device 48 is inserted into the lower receiver 45, the gate member 41 will be locked in the raised position. If a person were to attempt to lower the raised gate member 41 when the locking device 48 is inserted into the lower receiver 45, the locking device 48 would abut against the lower plate 59 of the enclosure 50 and thus prevent the gate member 41 from being lowered such as shown in FIG. 10.

As best shown in FIGS. 9-11, each of the gate members 41 may comprise a tube which fits between adjacent bollards 30. The gate members 41 may comprise various cross-sections, including but not limited to triangular, rectangular, diamond-shaped, polygonal, or other cross-sections. In the exemplary figures, the gate members 41 each comprise a square-shaped or diamond-shaped cross-section so as to fit within the slots 34 between adjacent bollards 30. In embodiments such as those shown in the figures, the gate members 41 slide along, but do not contact, the bollards 30.

As the bollards 30 and gate members 41 are staggered in positioning, the bollards 30 do not interfere with movement of the gate members 41 between the raised and lowered positions. Thus, each of the gate members 41 may be positioned in the slot 34 between a pair of adjacent bollards 30, with the gate members 41 being movable between the slots 34. In this manner, the gate members 41 may be raised or lowered without contacting the bollards 30. The staggered nature of the bollards 30 and gate members 41 is best shown in FIG. 12.

D. Enclosure

As shown in FIGS. 9-11, the gate members 41 may extend through an enclosure 50. The enclosure 50 provides security to prevent unauthorized access to the locking device 48 and thus prevent the gate 40 from being raised or lowered without first accessing the interior chamber 54 of the enclosure 50. The enclosure 50 includes an access door 60 which may be selectively locked and unlocked to prevent or allow access to the interior chamber 54 to raise or lower the gate 40.

As best shown in FIGS. 12, 13, and 19, the enclosure 50 may comprise a rectangular box including an outer end 51, an inner end 52, an upper member 58, and a lower member 59. While the figures illustrate a generally rectangular enclosure 50, it should be appreciated that various other shapes could be utilized. For example, the enclosure 50 could be spherical, triangular, polygonal, or various other shapes.

As best shown in FIGS. 12 and 13, the outer end 51 of the enclosure 50 faces outwardly from the outer end 25 of the bollard panel 20. The inner end 52 of the enclosure faces outwardly from the inner end 26 of the bollard panel 20. As the outer end 26 of the bollard panel 20 faces in the direction from which passage is restricted, the access door 60 providing access to the interior chamber 54 of the enclosure 50 is generally positioned on the inner end 52 of the enclosure 50.

The enclosure 50 includes an interior chamber 54 which may only be access through the access door 60, which may be selectively locked to restrict access to the interior chamber 54. The locking device 48 used to lock the gate members 41 in a raised or lowered position is positioned within the interior chamber 54.

As best shown in FIGS. 18 and 19, the structure of the enclosure 50 may be designed so as to prevent tampering. The enclosure 50 may include a recessed portion 56 in which the hinge 63 for the access door 60 is positioned. Such a configuration prevents tampering with the hinge 63 when the access door 60 is closed.

As shown in FIG. 18, the enclosure 50 may comprise an upper member 58 and a lower member 59 which define the interior chamber 54. In the exemplary embodiment shown in the figures, the upper member 58 comprises an upper plate and the lower member 59 comprises a lower plate. While the figures illustrate that the upper and lower members 58, 59 comprise a flat surface, it should be appreciated that the upper and lower members 58, 59 may comprise curved surfaces in some embodiments.

The lower end 32 of each of the bollards 30 may be connected to the enclosure 50 such as shown in FIG. 19. In such embodiments, the bollards 30 may be connected to the upper member 58 of the enclosure 50 by various methods, such as but not limited to welding, brackets, clamps, fasteners, adhesives, and the like.

In other embodiments, the bollards 30 may extend through the upper member 58 of the enclosure 50, with the lower ends 32 of the bollards 30 terminating within the interior chamber 54. In such embodiments, the enclosure 50 may comprise openings, such as on the upper member 58, through which the bollards 30 may extend partially or fully into the interior chamber 54 of the enclosure 50.

As shown in FIGS. 14-17, the enclosure 50 may be connected between the first and second side members 27*a*, 27*b* of the bollard panel 20*a*, 20*b*, 20*c*, 20*d*. As best shown in FIG. 12, the outer end 51 of the enclosure 50 may be flush with the outer end 25 of the bollard panel 20. Such a configuration prevents an individual from using the enclosure 50, such as the upper member 58 of the enclosure 50, to aid in attempting to climb the bollard panel 20*a*, 20*b*, 20*c*, 20*d*.

Figure 5:
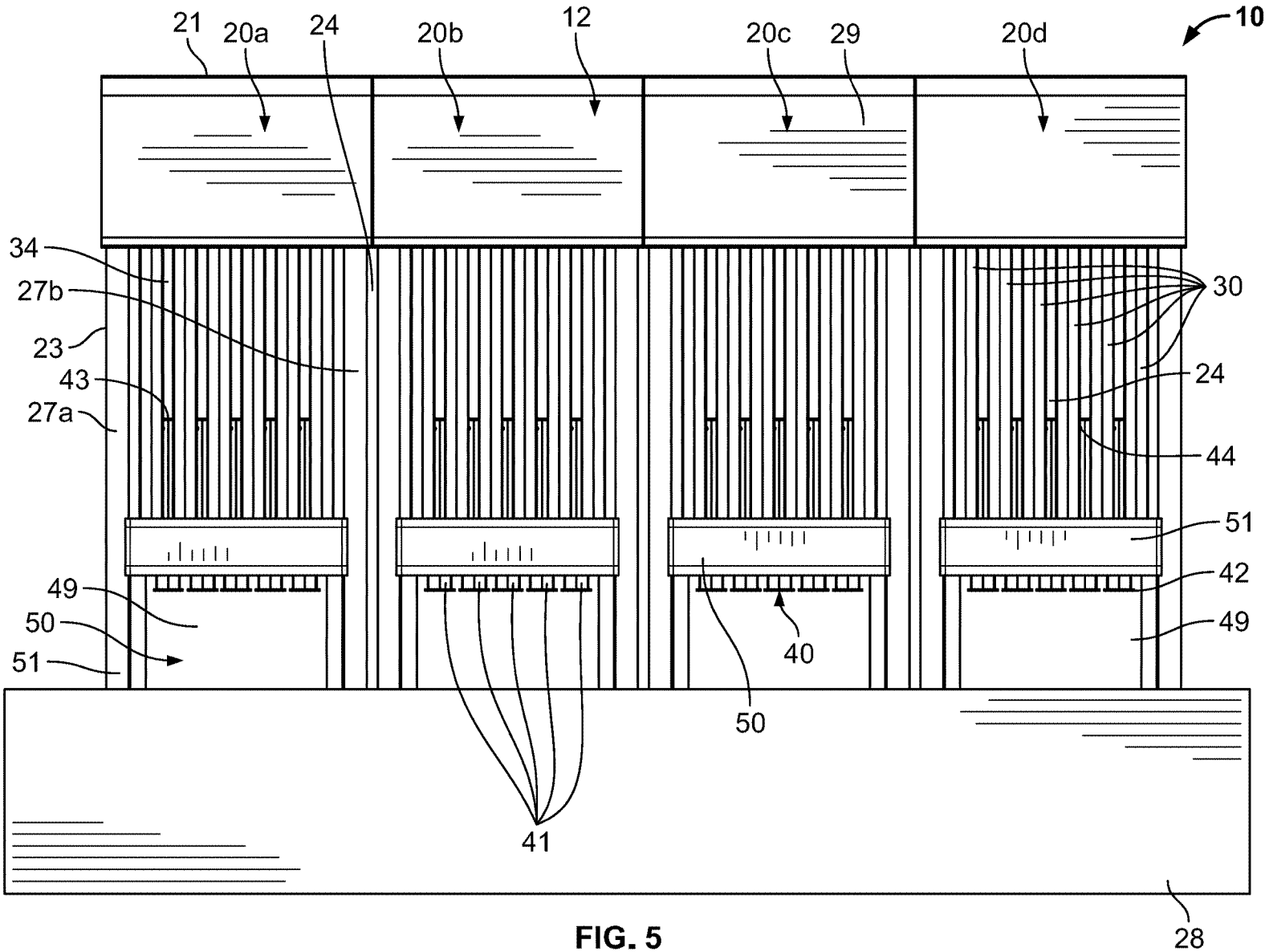
FIG. 5 is a front view of a bollard wall gate system with all gates in a raised position in accordance with an example embodiment.
Figure 6:
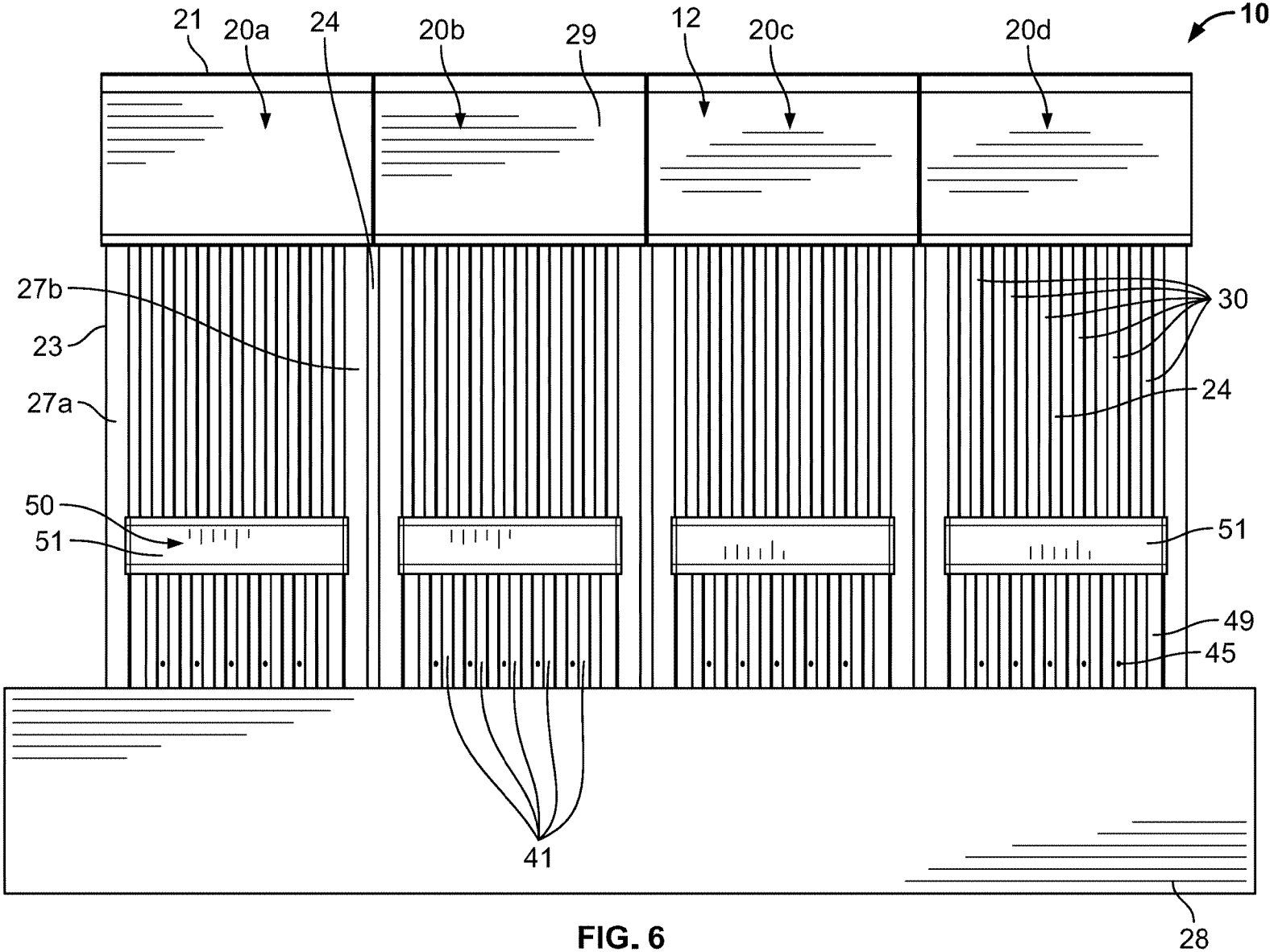
FIG. 6 is a front view of a bollard wall gate system with all gates in a lowered position in accordance with an example embodiment.

As shown in FIG. 5, the enclosure 50 is generally positioned above the lower end 22 of the bollard panel 20 so as to define the upper limit of the passageway 59 through the bollard panel 20. The enclosure 50 is thus positioned a distance above the ground surface 11 or footing 28, which defines the lower limit of the passageway 59.

The distance between the ground surface 11 or footing 28 (in embodiments in which the footing 28 is above-grade) and the enclosure 50 may vary in different embodiments to suit different applications, and thus should not be construed as limited by the exemplary figures. The enclosure 50 could be positioned higher or lower along the height of the bollard panel 20*a*, 20*b*, 20*c*, 20*d* than is shown in the exemplary embodiments of the figures.

The size of the enclosure 50 may also vary in different embodiments. In the exemplary embodiments shown in the figures, the enclosure 50 is of sufficient width to extend between the first and second sides 23, 24 of the bollard panel 20*a*, 20*b*, 20*c*, 20*d*. In other embodiments, the enclosure 50 may be narrower than the width of the bollard panel 20*a*, 20*b*, 20*c*, 20*d* and thus not extend fully between its first and second sides 23, 24. The height of the enclosure 50 may also vary depending on the length of the gate members 41.

As shown in FIGS. 9-11, 18, and 19, the gate 40 extends through the enclosure 50, with the upper and lower receivers 44, 45 being positioned within the interior chamber 54 of the enclosure 50 when in use (engaged by the locking device 48). The gate members 41 of the gate 40 will generally extend through both the upper and lower members 58, 59 of the enclosure 50 such as shown in FIGS. 18 and 19. The gate members 41 are each slidably connected through the enclosure 50 such that the gate members 41 may be moved between their raised and lowered positions.

As shown in FIGS. 18 and 19, the enclosure 50 may include an access door 60 which provides access to the interior chamber 54 of the enclosure 50 when opened and restricts access to the interior chamber 54 of the enclosure 50 when closed. The access door 60 may be comprised of a recessed, padlocked security door. The access door 60 is positioned on the inner end 52 of the enclosure 50 which faces outwardly from the inner end 26 of the bollard panel 20*a*, 20*b*, 20*c*, 20*d*. Thus, the access door 60 is not accessible from the outer end 25 of the bollard panel 20*a*, 20*b*, 20*c*, 20*d*.

The access door 60 may comprise various shapes, sizes, and configurations. In the exemplary embodiments shown in the figures, the access door 60 comprises a first end 61 and a second end 62. The first end 61 of the access door 60 includes a hinge 63 which allows the access door 60 to rotate between an opened and closed position. As best shown in FIG. 18, the hinge 63 may be recessed such that the hinge 63 is flush with the inner end 52 of the enclosure 50. Thus, the hinge 63 may be positioned within the recessed portion 56 of the enclosure's 50 inner end 52. In this manner, tampering or unauthorized access to the hinge 63 may be prevented.

The access door 60 may be selectively locked in its closed position. The enclosure 50 may comprise an enclosure connector 55 on its inner end 52 such as shown in FIG. 18. The enclosure connector 55 is adapted to receive and engage with the access door 60. In the exemplary embodiment shown in the figures, the enclosure connector 55 includes a loop connector 57 extending outwardly. As discussed below, a padlock 67 or other locking device may be removably connected to the loop connector 57 when the access door 60 is closed to prevent unauthorized access to the interior chamber 54 of the enclosure 50.

The second end 62 of the access door 60 may comprise a door connector 64 as shown in FIG. 18. The door connector 64 may include a connector opening 65 through which the loop connector 57 extends when the access door 60 is closed. As best shown in FIG. 19, a padlock 67 or other type of securing device may be removably connected through the loop connector 57 when the access door 60 is closed so as to lock the access door 60 in the closed position. The access door 60 will not be able to be opened until the padlock 67 is removed.

E. Operation of Preferred Embodiment

In use, one or more bollard panels 20*a*, 20*b*, 20*c*, 20*d* are first secured in the ground surface 11 to form a bollard wall 12. As previously mentioned, the number of bollard panels 20*a*, 20*b*, 20*c*, 20*d* used to form a wall will vary in different embodiments depending on such considerations as the length of the desired bollard wall 12 and the width of each bollard panel 20*a*, 20*b*, 20*c*, 20*d* used. In some embodiments, a single bollard panel 20*a*, 20*b*, 20*c*, 20*d* may comprise the bollard wall 12. In other embodiments, tens, hundreds, or even thousands of the bollard panels 20*a*, 20*b*, 20*c*, 20*d* could be used to form a single continuous bollard wall 12.

The manner in which the bollard wall 12 is formed by the bollard panels 20*a*, 20*b*, 20*c*, 20*d* may vary in different embodiments. In one exemplary embodiment, the bollard panels 20*a*, 20*b*, 20*c*, 20*d* may be connected to each other in series to form the continuous bollard wall 12. In other embodiments, the bollard panels 20*a*, 20*b*, 20*c*, 20*d* may not be connected directly to each other, but instead be positioned in the ground surface 11 so as to abut to form the continuous bollard wall 12. In some embodiments, certain panels may not comprise bollard panels 20*a*, 20*b*, 20*c*, 20*d*. For example, bollard panels 20*a*, 20*b*, 20*c*, 20*d* could be interspersed with solid concrete walls, fencing, or the like.

In FIGS. 1-8, it can be seen that the bollard panels 20*a*, 20*b*, 20*c*, 20*d* are connected at their respective lower ends 22 to a footing 28. The footing 28 may itself be burned underneath the ground surface 11 in some embodiments, with the passageway 49 being defined between the ground surface 11 and the bollard panel 20*a*, 20*b*, 20*c*, 20*d*.

In other embodiments, the footing 28 may extend above the ground surface 11 to form a base for the bollard panels 20*a*, 20*b*, 20*c*, 20*d*. In such embodiments, the passageway 49 is defined between the bollard panel 20*a*, 20*b*, 20*c*, 20*d* and the footing 28. In the exemplary embodiment shown in FIGS. 14-17, it can be seen that the bollard panels 20*a*, 20*b*, 20*c*, 20*d* may be connected directly into the ground surface 11. In such embodiments, a footing 28 may be omitted. In such embodiments, the passageway 49 is defined between the bollard panel 20*a*, 20*b*, 20*c*, 20*d* and the ground surface 11.

The manner in which the bollard panels 20*a*, 20*b*, 20*c*, 20*d* are installed may in the ground surface 11 may vary in different embodiments. By way of example, the side members 27*a*, 27*b* of each bollard panel 20*a*, 20*b*, 20*c*, 20*d* may be driven directly into the ground surface 11 such as shown in FIG. 14. In such embodiments, the side members 27*a*, 27*b* should be configured so as to extend a sufficient depth below the ground surface 11 to support the bollard panels 20*a*, 20*b*, 20*c*, 20*d* in an upright position.

In other embodiments, the bollard panels 20*a*, 20*b*, 20*c*, 20*d* may be cured in place within a footing 28 such as a concrete footing 28. In such embodiments, a ditch or other ground opening may be dug. The bollard panels 20*a*, 20*b*, 20*c*, 20*d* may be supported within the ground opening, such as by a boom, an excavator, support braces, or other methods. Concrete may then be poured into the ground opening so as to encapsulate and surround the lower end 22 of the bollard panels 20*a*, 20*b*, 20*c*, 20*d*. The concrete may then be allowed to cure in place to secure the bollard panels 20*a*, 20*b*, 20*c*, 20*d* within a concrete footing 28.

After installation, the bollard wall 12 is ready for use. The outer end 25 of the bollard panels 20*a*, 20*b*, 20*c*, 20*d* face in the direction from which passage is restricted. The inner end 26 of the bollard panels 20*a*, 20*b*, 20*c*, 20*d* face in the direction of the protected area. During normal usage, the gates 40 of the bollard panels 20*a*, 20*b*, 20*c*, 20*d* are kept in their lowered and locked position, preventing egress through the passageway 49.

In such a position, the enclosure 50 is sealed by the closed access door 60 as shown in FIG. 19. The locking device 48 is inserted through the upper receiver 44 of each of the gate members 41 such as shown in FIG. 18. In this position, the locking device 48 abuts against the lower end of the upper member 58, thus preventing the gate members 41 from being raised without removal of the locking device 48.

As shown in FIG. 9, in the locked and lowered position, the access door 60 is closed and locked, such as by use of a padlock 67 connected within the loop connector 57 of the enclosure 50. With the padlock 67 so engaged, the access door 60 may not be opened. The hinge 63 of the access door 60 is recessed within the recessed portion 56 so as to be flush with the inner end 52 of the enclosure 50 to prevent tampering with the hinge 63.

At times it will be necessary to open the gate 40 to expose the passageway 49. By way of example, during times of flooding, any debris which is larger than the slots 34 between the bollards 30 will collect against the bollard panels 20*a*, 20*b*, 20*c*, 20*d*. Accumulation of such debris may impact the structural integrity of the bollard wall 12. It is thus desirable to allow such debris to pass through the bollard panel 20*a*, 20*b*, 20*c*, 20*d* during times of flooding. It may also be desirable to open up the gate 40 within the bollard panel 20*a*, 20*b*, 20*c*, 20*d* to allow egress of authorized humans or animals.

To raise the gate 40 and open up the passageway 49 through the bollard panel 20*a*, 20*b*, 20*c*, 20*d*, the access door 60 must first be opened to provide access to the interior chamber 54 of the enclosure 50. To open the access door 60, the padlock 67 is first disengaged and removed from the loop connector 57 of the enclosure connector 55. The access door 60 may then be swung open to expose the interior chamber 54 in which the locking device 48 may be accessed.

The access door 60 may be opened when the gate 40 is in the lowered position. With the access door 60 opened and the locking device(s) 48 removed, the gate members 41 are freely slidable vertically within the enclosure 50. An individual need only grasp the handles 46 and lift upwardly to raise the gate members 41.

Once raised into position, the locking device 48 may be inserted into the lower receiver 45 of each gate member 41. A single individual may thus operate the gate 40 with one hand on the handle 46 and the other hand holding the locking device 48 to be inserted into the upper or lower receiver 44, 45 depending on if the gate 40 is being raised or lowered.

FIG. 18 illustrates gate members 41 locked in a raised position with the access door 60 opened to expose the interior chamber 54 of the enclosure 50. As can be seen, the locking devices 48 rest against the upper end of the lower member 59 of the enclosure 50 such that the gate members 41 may not be lowered any further without first removing the locking devices 48. The access door 60 may then be closed and locked by engaging the padlock 67 within the loop connector 57.

Figure 7:
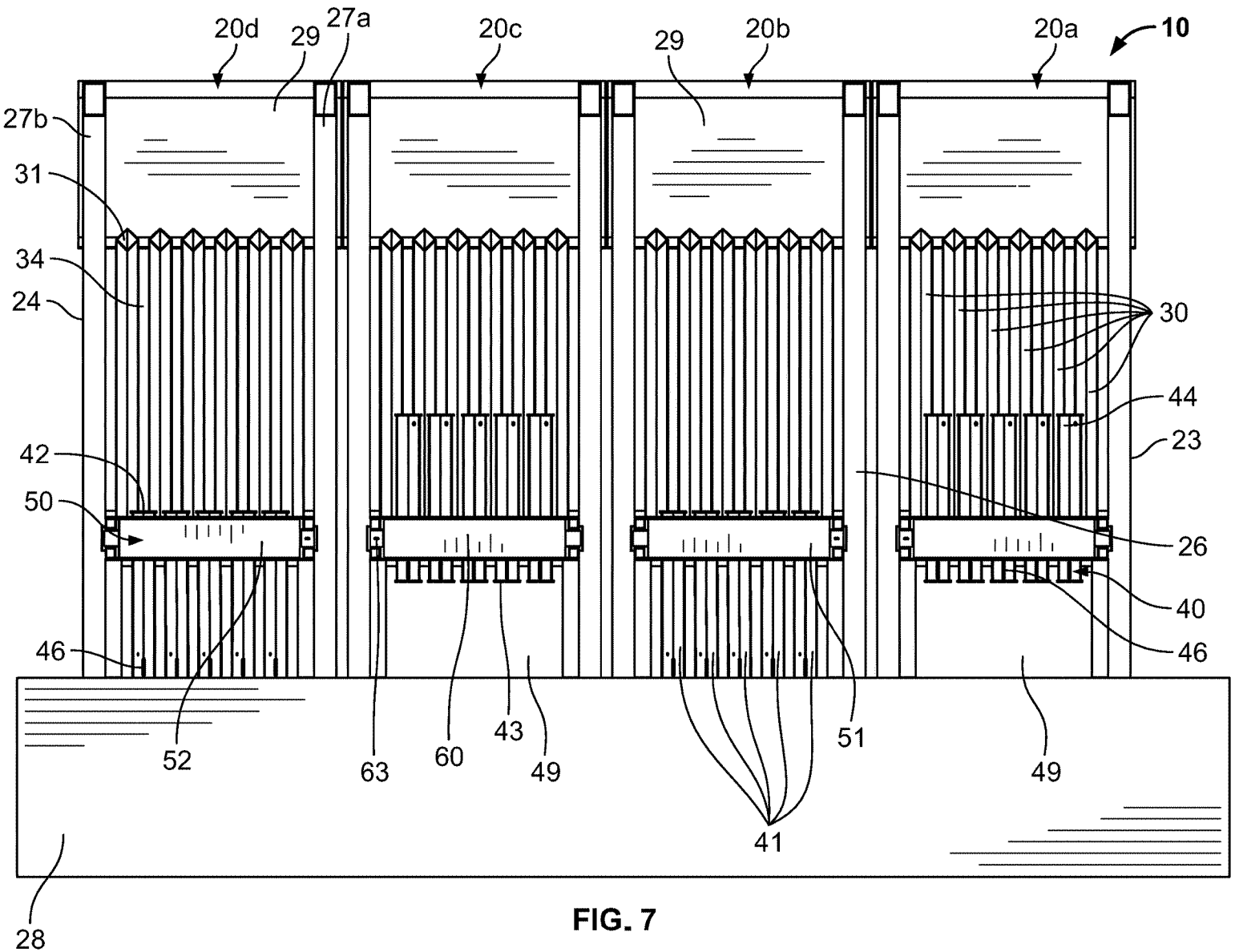
FIG. 7 is a rear view of a bollard wall gate system with gates in both raised and lowered positions in accordance with an example embodiment.
Figure 8:
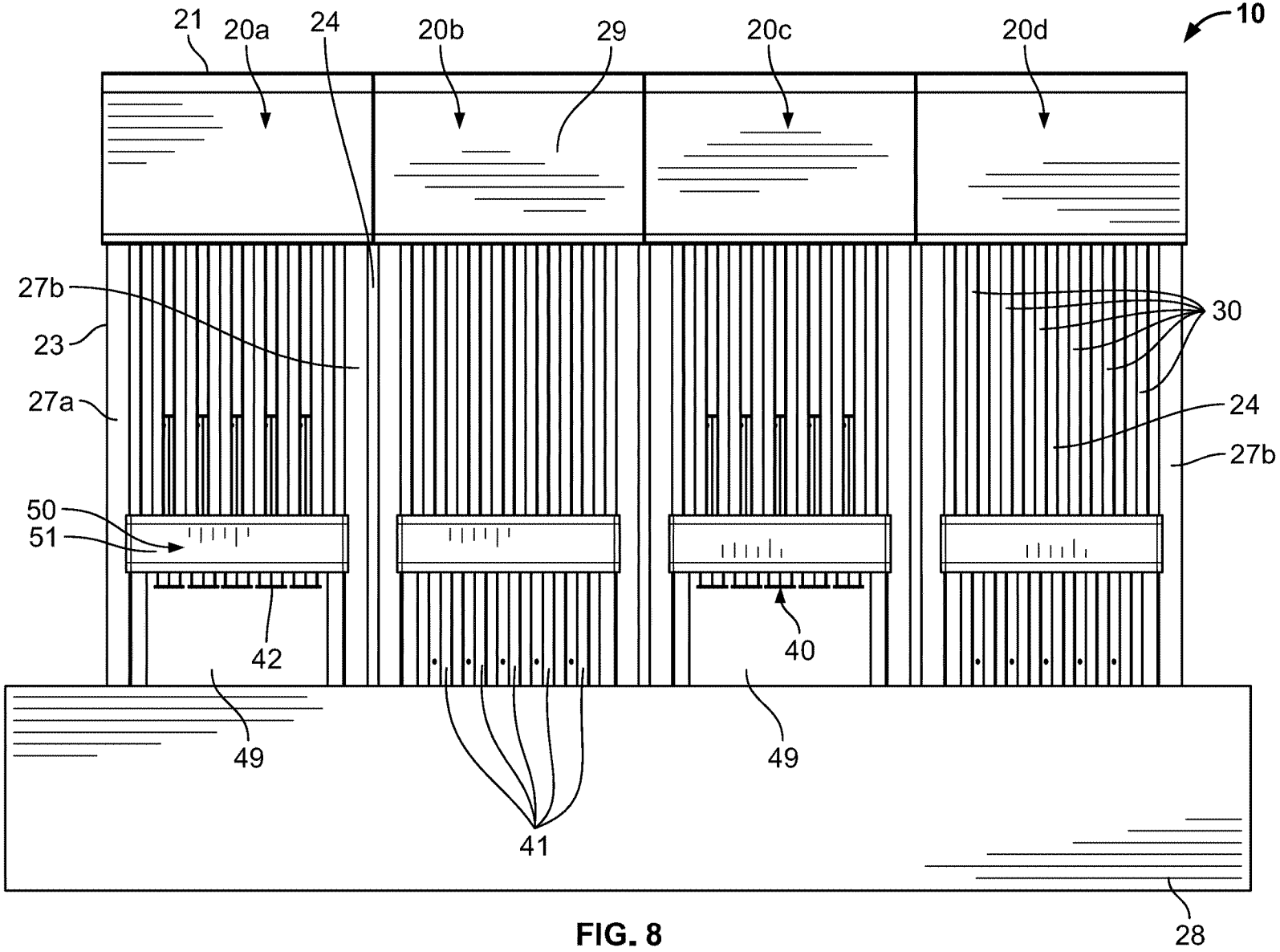
FIG. 8 is a front view of a bollard wall gate system with gates in both raised and lowered positions in accordance with an example embodiment.

With the gate members 41 in the raised position, passageway 49 is exposed so as to allow flood debris, authorized humans, or animals to pass through the bollard panel 20*a*, 20*b*, 20*c*, 20*d*. As shown in FIGS. 7 and 8, not all gates 40 of a bollard wall 12 need be opened. In some circumstances, it may be preferable to open only certain gates 40 while leaving the remaining passageways 49 covered. For example, if flood debris is only collecting on certain bollard panels 20*a*, 20*b*, 20*c*, 20*d* of a bollard wall 12, only those affected bollard panels 20*a*, 20*b*, 20*c*, 20*d* need have their gates 40 opened.

After the situation necessitating opening of the passageway 49 has concluded, the gates 40 may be lowered again. The access door 60 is first unlocked by removing the padlock 67. The access door 60 is then opened to expose the interior chamber 54. The locking devices 48 are removed from the lower receiver 45 of the gate members 41. The gate members 41 may then naturally fall into the lowered position by force of gravity. In other embodiments, the handles 46 may be grasped so as to manually lower the gate members 41.

In either case, the gate members 41 are secured into the lowered position by inserting the locking devices 48 through the upper receivers 44 of the gate members 41. The access door 60 is then closed and locked by re-engaging the padlock 67 with the loop connector 57. The gate 40 may be raised again when needed using the previously discussed method.

Unless otherwise defined, all technical and scientific terms used herein have the same meaning as commonly understood by one of ordinary skill in the art to which this invention belongs. Although methods and materials similar to or equivalent to those described herein can be used in the practice or testing of the bollard wall gate system, suitable methods and materials are described above. All publications, patent applications, patents, and other references mentioned herein are incorporated by reference in their entirety to the extent allowed by applicable law and regulations. The bollard wall gate system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A bollard wall gate system, comprising:

a bollard panel comprising opposing upper and lower ends and opposing first and second vertical sides, wherein the bollard panel comprises a plurality of vertical bollards adjacent the upper end, wherein the plurality of bollards are distally spaced so as to define a plurality of slots, and wherein the bollard panel comprises a passageway defined between the first and second sides at the lower end;

an enclosure connected to the bollard panel, the enclosure comprising an upper member and an opposing lower member extending at least partially between the first and second sides of the bollard panel;

a gate comprising a plurality of vertical gate members movably connected to the bollard panel, wherein the plurality of gate members each movably extend through the upper member and the lower member of the enclosure, the gate members each being adjustable between a raised opened position and a lowered closed position, wherein the passageway is blocked by at least one of the gate members when the at least one gate member is in the closed position, wherein each gate member includes an upper receiver, and wherein the upper receiver is positioned between the upper member and the lower member when in the closed position; and at least one locking device for locking the gate members in the closed position, wherein the locking device is removably inserted into the upper receiver of at least one of the gate members within the enclosure between the upper member and the lower member when the gate member is in the closed position such that the locking device abuts against the upper member of the enclosure to prevent the gate member from being moved to the opened position.

2. The bollard wall gate system of claim 1, wherein the upper receiver comprises an upper opening.

3. The bollard wall gate system of claim 1, wherein each of the gate members comprises a lower receiver.

4. The bollard wall gate system of claim 3, wherein the at least one locking device is inserted into the lower receiver of at least one of the gate members to lock the gate member in the opened position.

5. The bollard wall gate system of claim 3, wherein the lower receiver of each of the gate members is positioned between the upper member and the lower member of the enclosure when the gate member is in the opened position.

6. The bollard wall gate system of claim 1, wherein the enclosure comprises an access door hingedly connected to the enclosure.

7. The bollard wall gate system of claim 6, wherein the access door is hingedly connected to the enclosure by a recessed hinge.

8. A bollard wall gate system, comprising:

a bollard panel comprising opposing upper and lower ends and opposing first and second vertical sides, wherein the bollard panel comprises a plurality of vertical bollards adjacent the upper end, wherein the plurality of bollards are distally spaced so as to define a plurality of slots, and wherein the bollard panel comprises a passageway defined between the first and second sides at the lower end;

an enclosure connected to the bollard panel, the enclosure comprising an upper member and an opposing lower member extending at least partially between the first and second sides of the bollard panel, and an access door, wherein the access door is hingedly connected to the enclosure by a recessed hinge;

a gate comprising a plurality of vertical gate members movably connected to the bollard panel, wherein the plurality of gate members each movably extend through the upper member and the lower member of the enclosure, the gate being adjustable between a raised opened position and a lowered closed position, wherein the passageway is blocked by at least one of the gate members when the at least one gate member is in the closed position, wherein each of the plurality of gate members includes an upper receiver and a lower receiver, and wherein the upper receiver is positioned between the upper member and the lower member when in the closed position; and at least one locking device for locking the gate members in the closed position, wherein the locking device is removably inserted into the upper receiver of at least one of the gate members within the enclosure between the upper member and the lower member when the gate member is in the closed position such that the locking device abuts against the upper member of the enclosure to prevent the gate member from being adjusted to the opened position.

9. The bollard wall gate system of claim 8, wherein the at least one locking device is removably connected to the lower receiver of at least one of the plurality of gate members to lock the gate member in the opened position.

10. A bollard wall gate system, comprising:

a bollard panel comprising an upper end and an opposing lower end, a first vertical side and an opposing second vertical side, an outer end, and an inner end, wherein the bollard panel comprises a plurality of vertical bollards adjacent the upper end, wherein the plurality of bollards are distally spaced so as to define a plurality of slots, and wherein he bollard panel comprises a passageway defined between the first and second sides at the lower end;

an enclosure connected to the bollard panel, the enclosure comprising an upper member and an opposing lower member extending at least partially between the first and second sides of the bollard panel, and an access door, wherein the access door of the enclosure is flush with the outer end of the bollard panel;

a gate comprising a plurality of vertical gate members movably connected to the bollard panel, wherein the plurality of gate members each movably extend through the upper member and the lower member of the enclosure, the gate members each being adjustable between a raised opened position and a lowered closed position, wherein the passageway is blocked by at least one of the gate members when the at least one gate member is in the closed position, wherein each of the plurality of gate members includes an upper receiver and a lower receiver, and wherein the upper receiver is positioned between the upper member and the lower member when in the closed position; and at least one locking device for locking the gate members in the closed position or the opened position, wherein the locking device is removably connected to the upper receiver of at least one of the plurality of gate members within the enclosure between the upper member and the lower member when the gate member is in the closed position such that the locking device abuts against the upper member of the enclosure to prevent the gate member from being adjusted to the opened position, wherein the locking device is removably connected to the lower receiver of at least one of the plurality of gate members within the enclosure when the gate member is in the opened position such that the locking device is positioned between the upper member and the lower member of the enclosure to prevent the gate member from being adjusted to the closed position.

11. The bollard wall gate system of claim 10, wherein the enclosure comprises an access door hingedly connected to the enclosure.

12. The bollard wall gate system of claim 10, wherein the access door is hingedly connected to the enclosure by a recessed hinge.

* * * * *